US012085314B2

(12) United States Patent
Yan

(10) Patent No.: US 12,085,314 B2
(45) Date of Patent: Sep. 10, 2024

(54) AIR CONDITIONER/HEAT PUMP EXPANSION FUNCTION BOX AND AIR CONDITIONER/HEAT PUMP HEAT STORAGE REFRIGERATION SYSTEM

(71) Applicant: Fei Yan, Shenyang (CN)

(72) Inventor: Fei Yan, Shenyang (CN)

(73) Assignee: Fei Yan, Shenyang (CN)

( * ) Notice: Subject to any disclaimer, the term of this patent is extended or adjusted under 35 U.S.C. 154(b) by 512 days.

(21) Appl. No.: 17/394,385

(22) Filed: Aug. 4, 2021

(65) Prior Publication Data

US 2021/0364195 A1 Nov. 25, 2021

Related U.S. Application Data

(63) Continuation of application No. PCT/CN2020/075710, filed on Feb. 18, 2020.

(51) Int. Cl.
*F25B 13/00* (2006.01)
*F25B 41/24* (2021.01)

(52) U.S. Cl.
CPC ..... *F25B 13/00* (2013.01); *F25B 41/24* (2021.01); *F25B 2313/006* (2013.01); *F25B 2313/0231* (2013.01); *F25B 2313/0233* (2013.01)

(58) Field of Classification Search
CPC .... F25B 13/00; F25B 41/24; F25B 2313/006; F25B 2313/0231; F25B 2313/0233
See application file for complete search history.

(56) References Cited

FOREIGN PATENT DOCUMENTS

CN 102645060 A * 8/2012
CN 204027096 U * 12/2014
(Continued)

OTHER PUBLICATIONS

Yang et al., Bifurcation Box and Multi on line Air Conditioner, Jan. 14, 2015, CN204100388U, Whole Document (Year: 2014).*
(Continued)

*Primary Examiner* — Larry L Furdge
(74) *Attorney, Agent, or Firm* — Nitin Kaushik

(57) ABSTRACT

The application relates to an air conditioner/heat pump expansion function box and an air conditioner/heat pump heat storage refrigeration system, and belongs to the technical field of air conditioner/heat pump systems. Two distribution pipelines are arranged in the air conditioner/heat pump expansion function box body; each distribution pipeline comprises a main pipeline and at least one branch pipeline; the two ends of each main path are provided with an outdoor unit nut head and an indoor unit nut head respectively. The end portion, far away from the main path, of each branch path is provided with a radiation assembly nut head; an outdoor unit nut head is connected with an outdoor unit, an indoor unit nut head is connected with an indoor unit, and a radiation assembly nut head is connected with a radiation assembly. Therefore, an air conditioner/heat pump heat storage refrigeration system is formed, reasonable distribution of water-free floor heating pipelines is achieved, the energy efficiency ratio of the air conditioner/heat pump system is increased, pipeline connection of a unit is achieved under the non-oxidation condition, it is guaranteed that no impurities exist in the system pipelines, the service life of the unit is long, the assembling efficiency is improved, no welding process exists on site, operation is easy, and the appearance is attractive.

2 Claims, 20 Drawing Sheets

(56) References Cited

FOREIGN PATENT DOCUMENTS

| | | | |
|---|---|---|---|
| CN | 204100388 U | * | 1/2015 |
| JP | H04106372 A | * | 4/1992 |

OTHER PUBLICATIONS

Zhao, Multi Split Air Conditioning System, Aug. 22, 2012, CN 102645060A, Whole Document (Year: 2012).*
Liu et al., Multi Split Air Conditioner Branch Box, Dec. 17, 2014, CN204027096U, Whole Document (Year: 2014).*
Katsuna, Refrigerating Device, Apr. 8, 2012, JPH04106372A, Whole Document (Year: 1992).*

* cited by examiner

AIR CONDITIONER/HEAT PUMP EXPANSION FUNCTION BOX AND AIR CONDITIONER/HEAT PUMP HEAT STORAGE REFRIGERATION SYSTEM

FIELD OF THE INVENTION

The application relates to the technical field of air conditioner/heat pump systems, in particular to an air conditioner/heat pump expansion function box and an air conditioner/heat pump heat storage refrigeration system.

BACKGROUND OF THE INVENTION

In recent years, there is a novel product, commonly known as "water-free floor heating", on the air source heat pump heating market, and the "water-free floor heating" is further developed, so that "water-free dry-type floor heating" appears. However, these new manufacturers have not found a more reasonable mode on the aspects of unit function expansion and pipeline connection, so product development is limited to a large degree, and especially pipeline connection still stays on the level of site welding. The shortcomings are shown as follows: I. Unremovable (copper oxide scale separation) impurities are brought into a new unit pipeline system inevitably in site welding; II. The cleanliness of the environment may not be guaranteed at the construction site, and the quality (free of leakage within 30 years) of natural welding can hardly be guaranteed; III. Quality should be guaranteed in site welding, so the requirements on installation workers are high, and promotion and popularization are improper; IV. The procedures of pressing, leakage detection and the like after site welding are complex, so hidden dangers are generated, work hours are wasted, and it is very uncomfortable to the sense.

CONTENT OF THE INVENTION

The application provides an air conditioner/heat pump expansion function box and an air conditioner/heat pump heat storage refrigeration system. Different nut heads of the air conditioner/heat pump expansion function box, a preset outdoor unit, a preset indoor unit and preset radiation assemblies are rapidly installed, so that pipelines are reasonably distributed, the whole machine energy efficiency is improved, pipeline connection of a unit system are completed under the oxidation-free condition, there is no impurities in a pipeline system, the unit service life is long, no welding process is used on site, the operation is easy, the appearance is attractive, and the above problems are relieved.

The air conditioner/heat pump expansion function box according to the first embodiment of the application is applied to the air conditioner/heat pump heat storage refrigeration system, and the air conditioner/heat pump expansion function box comprises expansion function box bodies and two distribution pipelines installed in the expansion function box bodies; and each distribution pipeline in the two distribution pipelines comprises a main path and at least one branch path communicating with the main path, the two ends of each main path are provided with an outdoor unit nut head and an indoor unit nut head correspondingly, the end portion, away from the main path, of each branch path is provided with a radiation assembly nut head, one radiation assembly nut head group is formed by all the radiation assembly nut heads of each distribution pipeline, the two outdoor unit nut heads are used for being connected with an inlet and an outlet of an outdoor unit correspondingly, the two indoor unit nut heads are used for being connected with an inlet and an outlet of an indoor unit correspondingly, and the two radiation assembly nut head groups are used for being connected with inlets and outlets of radiation assemblies correspondingly.

According to the air conditioner/heat pump expansion function box in the embodiments of the application, outdoor unit nut heads are detachably connected with an outdoor unit, indoor unit nut heads are detachably connected with an indoor unit, and radiation assembly nut heads are detachably connected with radiation assemblies, so that pipelines are reasonably distributed, the whole machine energy efficiency is improved, the assembly efficiency may be conveniently improved, pipeline connection of the unit system are completed under the oxidation-free condition, there is no impurities in the pipeline system, the unit service life is long, no welding process is used on site, the operation is easy, and the appearance is attractive.

The air conditioner/heat pump heat storage refrigeration system according to the first embodiment of the application comprises an outdoor unit, an indoor unit, radiation assemblies and the air conditioner/heat pump expansion function box according to the first embodiment of the application, wherein an inlet and an outlet of the outdoor unit are connected with two outdoor unit nut heads of two distribution pipelines of the air conditioner/heat pump expansion function box correspondingly, an inlet and an outlet of the indoor unit are connected with two indoor unit nut heads of the two distribution pipelines of the air conditioner/heat pump expansion function box correspondingly, inlets and outlets of the radiation assemblies are connected with two radiation assembly nut head groups of the two distribution pipelines of the air conditioner/heat pump expansion function box correspondingly, the outdoor unit and the indoor unit are connected into a loop through the air conditioner/heat pump expansion function box, the outdoor unit and the radiation assemblies are connected into a loop through the air conditioner/heat pump expansion function box, and the indoor unit and the radiation assemblies are connected into a loop through the air conditioner/heat pump expansion function box.

Additional aspects and the advantages of the application will be given partially in the following description, part of which becomes obvious or be understood through the practice of the application.

DESCRIPTION OF ATTACHED FIGURES

In order to clarify the technical solution of the embodiments of the application, a brief description of the attached figures required for use in the embodiments is given below. It should be understood that the following attached figures are merely illustrative of certain embodiments of the application and are not intended to limit the application. For those of ordinary skill in the art, without creative work, other related attached figures can be obtained from these attached figures.

DETAILED MODE OF EXECUTION

In order to make the objects, technical solutions and advantages of the application more comprehensible, the technical solutions in the embodiments of the application will be further described in detail below with reference to the attached figures. Obviously, the described embodiments are part of the embodiments of the application and not all of them. Generally, the assemblies of the embodiments of the application described and shown in the attached figures herein may be arranged and designed in a variety of different configurations.

Therefore, the following detailed descriptions of the embodiments of the application provided in the attached figures are not intended to limit the protection scope of the application for which protection is required, but to represent the preferred embodiment of the application. Based on the embodiment of the application, all other embodiments acquired by the ordinary technicians in the art without inventiveness, should be in the protection scope of the application.

An air conditioner/heat pump heat storage refrigeration system 1 according to one embodiment of the application is described below with reference to the Figures.

Figure 1:
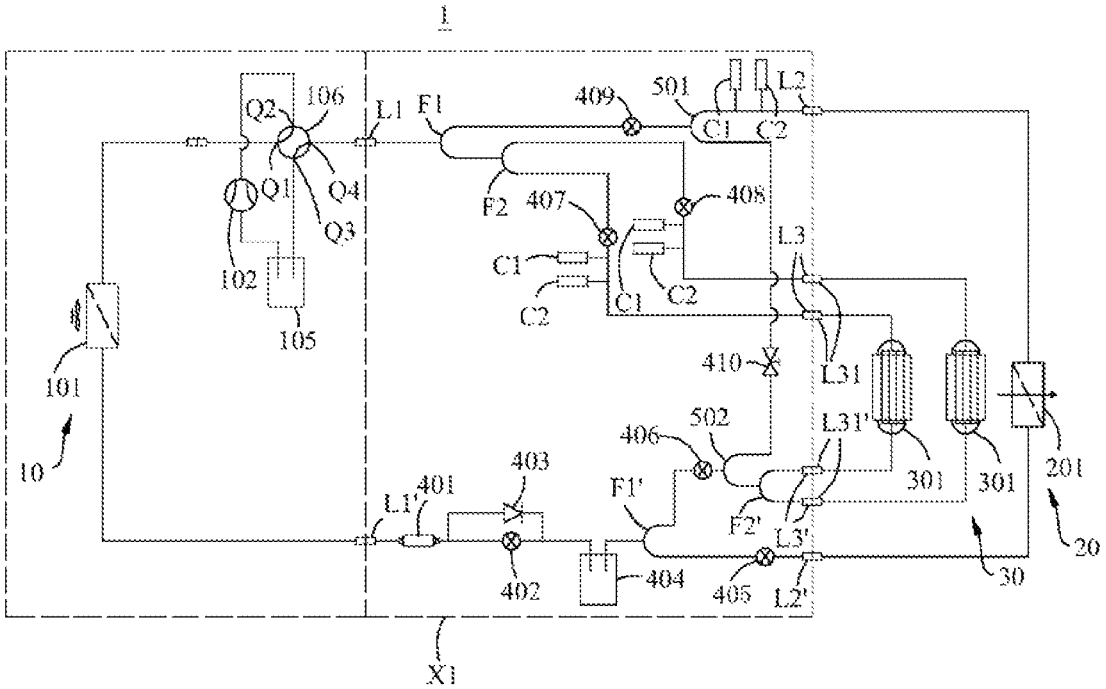
FIG. 1 is the first structural schematic diagram of an air conditioner/heat pump heat storage refrigeration system of the embodiments of the application.

As shown in FIG. 1, the air conditioner/heat pump heat storage refrigeration system 1 according to one embodiment of the application comprises an air conditioner/heat pump expansion function box, an outdoor unit 10, an indoor unit 20 and radiation assemblies 30.

Specifically, the air conditioner/heat pump expansion function box comprises expansion function box bodies X1 and two distribution pipelines installed in the expansion function box bodies X1.

Figure 2:
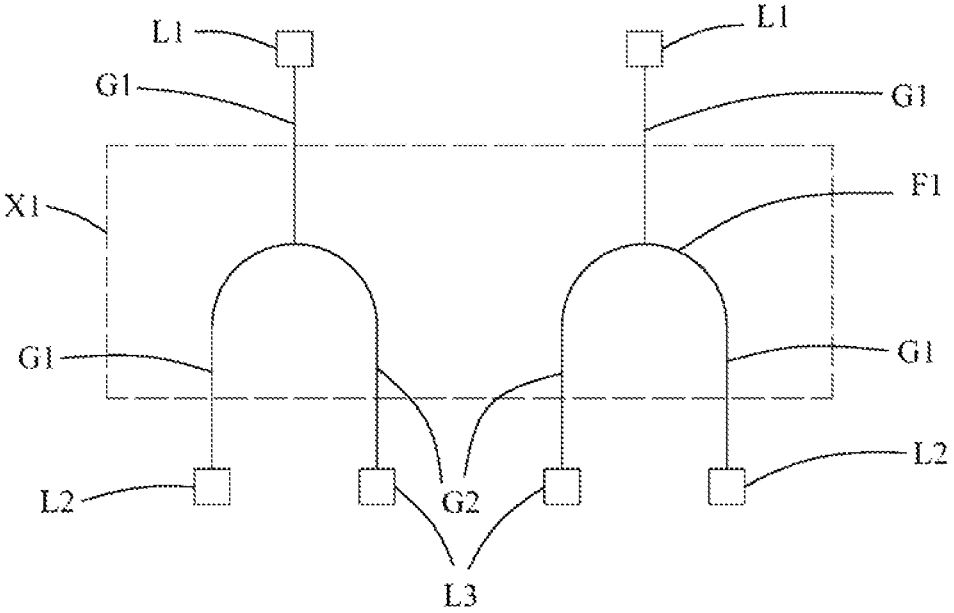
FIG. 2 is the first structural schematic diagram of an air conditioner/heat pump expansion function box in FIG. 1.

The expansion function box bodies X1 are bearing containers, have containing spaces, and may be metal box bodies (such as iron, aluminum or other alloys) or plastic box bodies (such as PC (Polycarbonate), ABS (AcrylonitrileButadiene Styrene), PP (Polypropylene) and PET (polyethylene glycol terephthalate) or box bodies prepared from combining metal and plastic. As shown in FIG. 2, each distribution pipeline in the two distribution pipelines comprises a main path G1 and at least one branch path G2 communicating with the main path G1. The two ends of each main path G1 are provided with an outdoor unit nut head L1 and an indoor unit nut head L2 correspondingly, the end portion, away from the main path G1, of each branch path G2 is provided with a radiation assembly nut head L3, one radiation assembly nut head group is formed by all the radiation assembly nut heads L3 of each distribution pipeline, the two outdoor unit nut heads L1 are used for being connected with an inlet and an outlet of an outdoor unit 10 correspondingly, the two indoor unit nut heads L2 are used for being connected with an inlet and an outlet of an indoor unit 20 correspondingly, and the two radiation assembly nut head groups are used for being connected with inlets and outlets of the radiation assemblies 30 correspondingly. Each radiation assembly nut head group is used for being connected with one end of one radiation assembly 30, each radiation assembly nut head group may be provided with a plurality of radiation assembly nut heads L3 according to the process requirements of the air conditioner/heat pump heat storage refrigeration system in order to correspond to a plurality of connection ports of the radiation assemblies 30, and usually the number of the radiation assembly nut heads L3 is even, so that uniform and reasonable distribution of the distribution pipelines and indoor pipeline arrangement are facilitated.

The inlet and the outlet of the outdoor unit 10 are connected with the two outdoor unit nut heads L1 of the two distribution pipelines correspondingly, the inlet and the outlet of the indoor unit 20 are connected with the indoor unit nut heads L2 of the two distribution pipelines correspondingly, the inlets and the outlets of the radiation assemblies 30 are connected with the two radiation assembly nut head groups of the two distribution pipelines correspondingly, the outdoor unit 10 and the indoor unit 20 are connected into a loop through the air conditioner/heat pump expansion function box, the outdoor unit 10 and the radiation assemblies 30 are connected into a loop through the air conditioner/heat pump expansion function box, and the indoor unit 20 and the radiation assemblies 30 are connected into a loop through the air conditioner/heat pump expansion function box.

The outdoor unit nut heads L1 and the inlet or the outlet of the outdoor unit 10 are rapidly connected, the indoor unit nut heads L2 and the inlet or the outlet of the indoor unit 20 are rapidly connected, the radiation assembly nut heads L3 and the inlets or the outlets of the radiation assemblies 30 are rapidly connected, meanwhile, the air conditioner/heat pump expansion function box and the outdoor unit 10 and the indoor unit 20 (and/or the radiation assemblies 30) form a loop, circulation of a flowing medium (flowing medium in the application refers to refrigerant, such as Freon, carbon dioxide and ammonia), pipelines are reasonably distributed, there is no welding in the installation site, the operation is easy, and the appearance is attractive.

Figure 3:
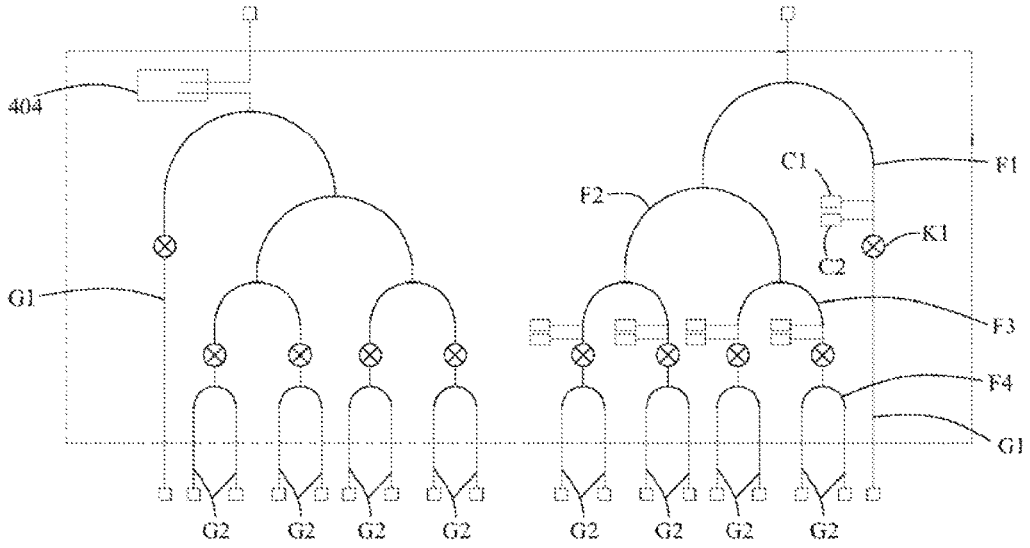
FIG. 3 is the second structural schematic diagram of an air conditioner/heat pump expansion function box in FIG. 1.

According to some embodiments of the application, as shown in FIG. 3, each distribution pipeline in the two distribution pipelines is provided with at least one expansion valve K1 and at least one sensor group corresponding to the at least one expansion valve K1, at least one distribution pipeline in the two distribution pipelines is connected with a liquid storage tank 404, each expansion valve K1 and each sensor group are used for being electrically connected with a control circuit board of the outdoor unit 10, and the control circuit board may control working states of the expansion valves K1 according to signals detected by the sensor groups to change flow of the flowing medium of the corresponding distribution pipelines. It should be noted that the expansion valves K1 may be electronic expansion valves and also may be pressure expansion valves (also may be mixed application of the electronic expansion valves and the pressure expansion valves), and different types of expansion valves K1 may be selected according to different actual working conditions. In other embodiments of the application, the control circuit board may be installed in the expansion function box bodies X1, so that circuits are conveniently overhauled and maintained.

The liquid storage tanks 404 are arranged in the distribution pipelines, after the air conditioner/heat pump expansion function box and the outdoor unit 10, the indoor unit 20 and the radiation assemblies 30 are connected into the air conditioner/heat pump heat storage refrigeration system 1, the shapes, sizes, positions and control of the liquid storage tanks 404 should be set according to the requirements of the system. In some specific embodiments of the application, the sensor groups comprise pressure sensors C1 and/or temperature sensors C2, and the sensor groups are installed in one distribution pipeline. When only the pressure sensors C1 are arranged in the distribution pipelines, the control circuit board may control the working states of the expansion valves K1 according to pressure signals detected by the pressure sensors C1 to change the flow of the flowing medium in the distribution pipelines; When only the temperature sensors C2 are arranged in the distribution pipelines, the control circuit board may control the working states of the expansion valves K1 according to pressure signals detected by the temperature sensors C2 to change the flow of the flowing medium in the distribution pipelines; When the pressure sensors C1 and the temperature sensors C2 are arranged in the distribution pipelines, the control circuit board may control the working states of the expansion valves K1 according to pressure signals or temperature signals detected by the pressure sensors or the temperature sensors to change the flow of the flowing medium in the distribution pipelines.

According to some embodiments of the application, each distribution pipeline comprises at least one manifold pipe, one manifold pipe in the at least one manifold pipe is a first-level manifold pipe F1, the first-level manifold pipe F1 comprises a first-level main pipe and two first-level branch pipes communicating with the first-level main pipe, the first-level main pipe and one first-level branch pipe in the two first-level branch pipes are constructed into a main path G1, and the other first-level branch pipe in the two first-level branch pipes is constructed into one branch path G2. The first-level main pipe and one first-level branch pipe of the first-level manifold pipe F1 form the main path G1 of each distribution pipeline, the other first-level branch pipe forms the branch path G2, the outdoor unit 10 and the indoor unit 20 are connected through the main path G1, and the outdoor unit 10 and the radiation assemblies 30 are connected through the branch path G2.

In some specific embodiments of the application, as shown in FIG. 2, the number of the manifold pipe of each distribution pipeline is one, the manifold pipe is the first-level manifold pipe F1, the first-level main pipe and one first-level branch pipe of the first-level manifold pipe F1 form the main path G1, and the other first-level branch pipe of the first-level manifold pipe F1 forms the first-level branch path. When the number of the manifold pipe is one, only one branch path G2 of the distribution pipelines is the first-level branch path, and the first-level branch path is only provided with one radiation assembly nut head L3.

Figure 4:
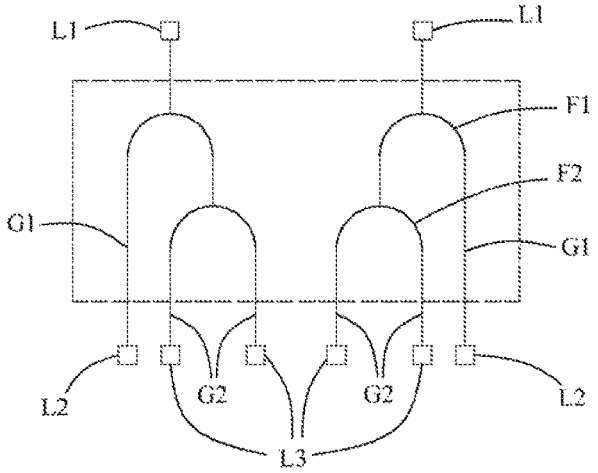
FIG. 4 is the third structural schematic diagram of an air conditioner/heat pump expansion function box in FIG. 1.

In some specific embodiments of the application, as shown in FIG. 4, the number of the manifold pipes of each distribution pipeline is two, the two manifold pipes are the first-level manifold pipe F1 and a second-level manifold pipe F2 correspondingly, the first-level main pipe and one first-level branch pipe of the first-level manifold pipe F1 are configured into one main path G1, the other first-level branch pipe of the first-level manifold pipe F1 is configured into the first-level branch path, the second-level main pipe communicates with the first-level branch pipe forming the first-level branch path, the two second-level branch pipes are configured into two second-level branch paths, and the radiation assembly nut heads L3 are located on the end portions of the second-level branch paths. The main path G1 of each distribution pipeline is composed of the first-level main pipe and one first-level branch pipe, two branch paths G2 of the distribution pipeline are formed by the two second-level branch paths connected with the first-level branch path, and the second-level branch paths are provided with two radiation assembly nut heads L3.

In some specific embodiments of the application, in order to facilitate understanding, the number of the manifold pipes of each distribution pipeline is 2n−1, wherein n is larger than or equal to 3 (n≥3), the manifold pipes comprise one first-level manifold pipe F1, one second-level manifold pipe F2, two third-level manifold pipes F3, . . . , 2n−2 n<th>-level manifold pipes, each n<th>-level manifold pipe comprises an n<th>-level main pipe and two n<th>-level branch pipes, and the n<th>-level branch pipes are constructed into n<th> branch paths. The first-level main pipe and one first-level branch pipe of the first-level manifold pipe F1 are constructed into the main path G1, and the other first-level branch pipe of the first-level manifold pipe F1 is constructed into the first-level branch path; the second-level manifold pipe F2 is located in the first-level branch path, a second-level main pipe of the second-level manifold pipe F2 communicates with the first-level branch pipe forming the first-level branch path, and two second-level branch pipes of the second-level manifold pipe are configured into two second-level branch paths; and each third-level manifold pipe F3 is located in one second-level branch path, a third-level main pipe of each third-level manifold pipe F3 communicates with one second-level branch pipe forming one second-level branch pipe, each third-level branch pipe is configured into a third-level branch pipe, in a similar way, a manifold pipe connected with an (n−1)<th>-level branch pip of the (n−1)<th>-level manifold pipe is an n<th>-level manifold pipe, n<th>-level branch pipes of the n<th>-level manifold pipes are configured into n<th>-level branch paths, and the 2n−2 n<th>-level manifold pipes are configured into 2n−1 n<th>-level branch paths. Equivalently, there is 2n−1 branch paths G2 in the 2n−1 manifold pipes of each distribution pipeline. As shown in FIG. 3, n is equal to 4 (n=4), and each distribution pipeline comprises eight manifold pipes.

Figure 5:
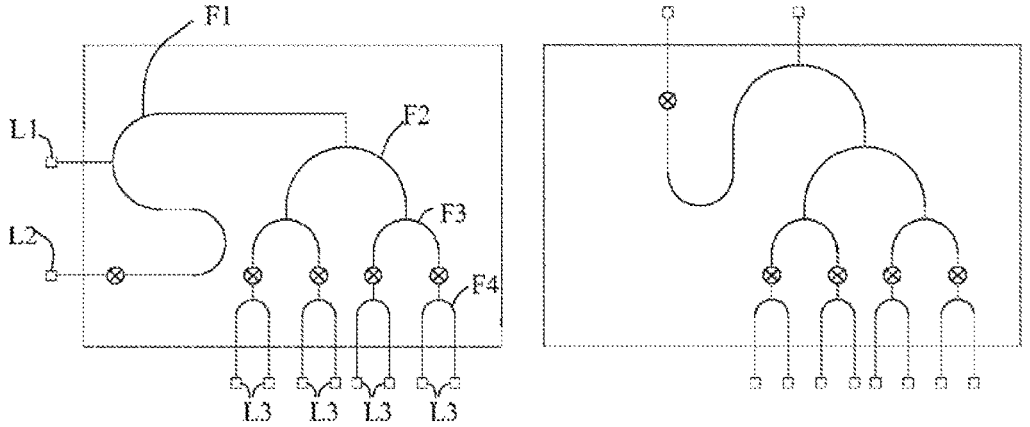
FIG. 5 is the fourth structural schematic diagram of an air conditioner/heat pump expansion function box in FIG. 1.

Furthermore, the expansion function box bodies X1 may be two (as shown in FIG. 5), each distribution pipeline is located in one expansion function box body X1, thus, reasonable distribution of pipelines and indoor actual application area is facilitated, and positions may be flexibly set. In the two expansion function box bodies X1, one is a flowing medium input box body, the other is a flowing medium output box body, and the shape, size, internal devices and position of each expansion function box body X1 may be set according to different sizes and functions of units.

Meanwhile, the positions of the outdoor unit nut heads L1 and the indoor unit nut heads L2 may be flexibly set, for example: the positions of the indoor unit nut heads L2 may be selected according to actual conditions, the positions of the indoor unit nut heads L2 and the positions of the radiation assembly nut heads L3 may be located on the same sides of the expansion function box bodies X1 (as shown in FIG. 3), and the positions of the indoor unit nut heads L2 and the positions of the outdoor unit nut heads L1 are located on the two sides of the expansion function box bodies X1; and the positions of the indoor unit nut heads L2 and the positions of the outdoor unit nut heads L1 are located on the same sides of the expansion function box bodies X1 (as shown in FIG. 5), and the positions of the indoor unit nut heads L2 and the positions of the radiation assembly nut heads L3 are located on the two sides of the expansion function box bodies X1. Reasonable connection of different positions of the pipelines may be achieved through the nut heads at different positions.

According to some embodiments of the application, the air conditioner/heat pump expansion function box comprises sub function boxes, each distribution pipeline is provided with at least one sub function box, each distribution pipeline comprises a main distribution pipeline and sub distribution pipelines, the sub distribution pipelines are located in the sub function boxes, each sub distribution pipeline comprises an n<th>-level manifold pipe matched with the main distribution pipeline, the n<th>-level manifold pipe communicates with one (n−1)<th>-level branch pipe of one (n−1)<th>-level manifold pipe of the main distribution pipeline, the end portions of (n−1)<th>-level branch pipes, matched with the sub distribution pipelines, of the main distribution pipelines are provided with connection outlet nut heads L41, the end portions of n<th> main pipes of the n<th> manifold pipes of the sub distribution pipelines are connected with connection inlet nut heads L42, the end portions of the two n<th>-level branch pipes of the n<th> manifold pipes are connected with radiation assembly nut heads correspondingly L3, and the connection inlet nut heads L42 are connected with the connection outlet nut heads L41. Equivalently, last-level manifold pipes (n<th>-level manifold pipes) of the distribution pipelines are located in sub function boxes, the sub function boxes are flexibly arranged and used for more reasonably distributing the distribution pipelines and the indoor actual pavement area, and pipeline pavement between different rooms is facilitated.

It should be noted that whether the number of the expansion function box body X1 is one or two, the distribution pipelines may be provided with at least one sub function box, and more reasonable distribution of the distribution pipelines and the indoor actual pavement area is achieved through the arrangement of the sub function boxes.

Figure 6:
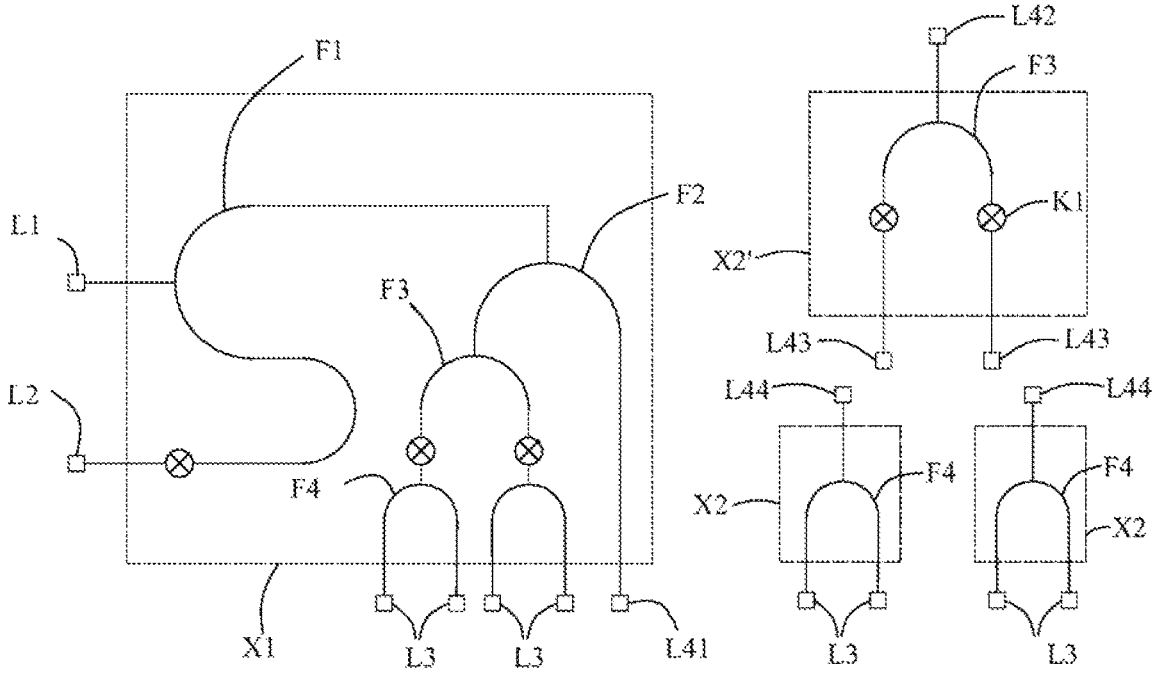
FIG. 6 is a structural schematic diagram of a sub function box of an air conditioner/heat pump expansion function box.
Figure 7:
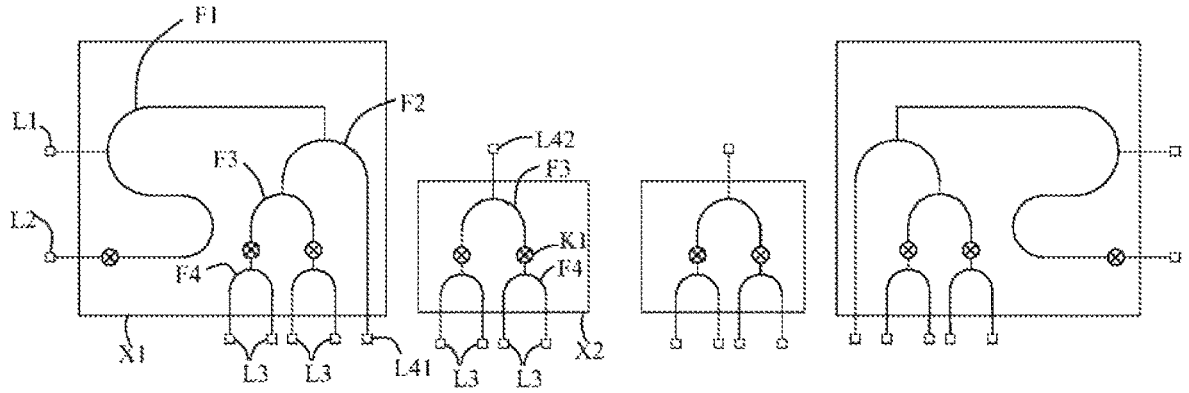
FIG. 7 is another structural schematic diagram of a sub function box of an air conditioner/heat pump expansion function box.

The sub function boxes comprise sub function box bodies X2, structures of sub distribution pipelines may be diverse, and optionally, two different structural forms are selected to be introduced: according to one structural form, the number of the sub function boxes corresponding to each distribution pipeline is two, the distribution pipelines are further provided with transition function boxes in order to facilitate assembly of the two sub function boxes, the transition function boxes comprise transition function box bodies X2' and (n−1)<th>-level manifold pipes matched with the sub function boxes, the (n−1)<th>-level manifold pipes are located in the transition function box bodies X2', as shown in FIG. 6, the distribution pipeline is provided with four levels of manifold pipes, third-level manifold pipes F3 are arranged in the transition function boxes, and each of the two sub function boxes comprises one fourth-level manifold pipe F4; and according to the other structural form, one (n−1)<th>-level manifold pipe and two n<th>-level manifold pipes are placed on the same sub function box, thus, two sub distribution pipelines are arranged in the sub function box, as shown in FIG. 7, the distribution pipeline is provided with four levels of manifold pipes, and the third-level manifold pipe F3 and the two fourth-level manifold pipes F4 are located in the sub function box bodies X2.

As shown in FIG. 6, main distribution pipelines in the expansion function box bodies X1 are used for carrying out pipeline distribution on a main room (master bedroom or space with large area), and two sub function boxes are used for carrying out pipeline distribution on two sub rooms (or space with small area). Each transition function box comprises a third-level manifold pipe F3, the two sub function boxes comprise fourth-level manifold pipes F4, the end portions of second-level branch pipes of the second-level manifold pipes F2, matched with the transition function boxes, of the main distribution pipelines are connected with connection outlet nut heads L41 (may be understood as first-level connection outlet nut heads), the end portions of third-level main pipes of the third-level manifold pipes F3 of the transition function boxes are connected with connection inlet nut heads L42 (may be understood as first-level connection inlet nut heads), the connection outlet nut heads L41 are connected with the connection inlet nut heads L42, the end portions of third-level branch pipes of the third-level manifold pipes F3 are connected with second-level connection outlet nut heads L43, the end portions of fourth-level main pipes of the fourth-level manifold pipes F4 of the sub function boxes are connected with second-level connection inlet nut heads L44, the second-level connection outlet nut heads L43 are connected with the corresponding second-level connection inlet nut heads L44, and the end portions of fourth-level branch pipes of the fourth-level manifold pipes F4 are connected with the radiation assembly nut heads L3. In order to conveniently achieve independent control over each sub function box, each of the two third-level branch pipe of the third-level manifold pipes F3 of the transition function boxes is provided with an expansion valve K1, and the expansion valve is used for controlling flow of flowing medium in the fourth-level manifold pipes F4 of the corresponding sub function boxes.

As shown in FIG. 7, the sub function boxes of the structural form are suitable for pipeline distribution of rooms with large area, each sub function box comprises a sub function box body X2, one third-level manifold pipe F3 and two fourth-level manifold pipes F4 matched with the third-level manifold pipe F3 are located in each sub function box, the end portion of a third-level main pipe of the third-level manifold pipe F3 is connected with the connection inlet nut head L42, the end portions of the second-level branch pipes, matched with the third-level manifold pipe F3, of the second-level manifold pipe of the main distribution pipeline are connected with the connection outlet nut heads L41, the connection outlet nut heads L41 are connected with the connection inlet nut heads L42, the end portions of the two fourth-level branch pipes of the fourth-level manifold pipe F4 in each sub function box are connected with the radiation assembly nut heads L3 correspondingly, each sub function box is provided with four radiation assembly nut heads L3, thus, the sub function boxes may be suitable for pipeline distribution of the rooms with large area, each of the two third-level branch pipes of the third-level manifold pipe F3 in each sub function box is provided with the expansion valve K1, the expansion valves are used for controlling the flow of the flowing medium in the corresponding fourth-level manifold pipes F4, during use, the sub function boxes may be put at needed positions according to position requirements of different radiation assemblies 30, and reasonable distribution of the distribution pipelines and the indoor actual pavement area is facilitated.

It should be noted that thicknesses (sectional area) of all the distribution pipelines and manifold pipes of the application are different due to different positions and are set according to the reasonability of the flow of the medium in the system pipelines. Each manifold pipe comprises one main pipe and two branch pipes, and pipe diameters of the main pipes and the branch pipes of the manifold pipes may be unequal or equal; and the two branch pipes are of a U-shaped or Y-shaped structure, so that installation and arrangement are facilitated. Materials of the manifold pipes may be of various types such as metal pipes, plastic pipes and synthetic pipes.

Figure 8:
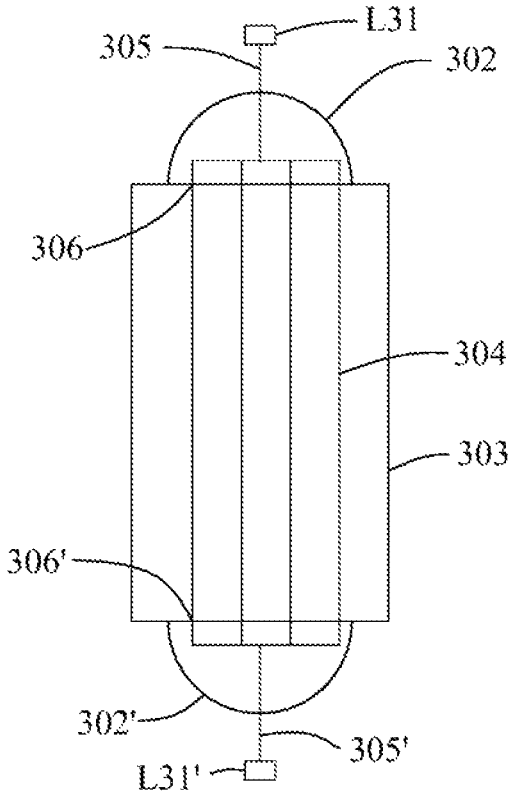
FIG. 8 is a structural schematic diagram of a radiation unit of a radiation assembly.

According to some embodiments of the application, the radiation assemblies 30 comprise distributors 302 corresponding to the radiation assembly nut heads L3, each distributor 302 is connected with one radiation assembly nut head L3, each distribution pipeline comprises a plurality of branch paths G2 (each branch path G2 is provided with one radiation assembly nut head L3), each radiation assembly 30 comprises a plurality of radiation units 301, an inlet end (or an outlet end) of each radiation unit 301 corresponds to one radiation assembly nut head L3 of one distribution pipeline in the two distribution pipelines, the outlet end (or the inlet end) of each radiation unit 301 corresponds to one radiation assembly nut head L3' of the other distribution pipeline in the two distribution pipelines (in order to conveniently distinguish parts in the two distribution pipelines, the radiation assembly nut head L3' is a radiation assembly nut head in the other distribution pipeline). As shown in FIG. 8, each radiation unit 301 comprises two distributors (distributor 302 and distributor 302') and a radiation part 303, the radiation part 303 comprises a plurality of heat exchange pipes 304 arranged side by side, the two distributors (distributor 302 and distributor 302') are located at the two ends of the radiation part 303, each distributor (distributor 302 and distributor 302') comprises one distributor connection inlet (distributor connection inlet 305 or distributor connection inlet 305') and a plurality of distributor connection outlets (distributor connection outlet 306 or distributor connection outlet 306'), and the plurality of distributor connection outlets (distributor connection outlets 306 or distributor connection outlets 306") are connected with the plurality of heat exchange pipes 304 in a one-to-one correspondence mode. Each distributor connection inlet 305 (or distributor connection inlet 305') is provided with a distributor connection inlet nut head L31 (or distributor connection inlet nut head L31'), and in the same radiation unit 301, one distributor connection inlet nut head L31 is connected with one radiation assembly nut head L3 of one distribution pipeline, and the other distributor connection inlet nut head L31' is connected with one radiation assembly nut head L3' of the other distribution pipeline. It should be noted that the heat exchange pipes 304 may be metal pipes (e.g. copper pipes) and also may be non-metal pipes (e.g. pressure-resistant and heat-conductive plastic pipes), and different types (different materials and different structures) of heat exchange pipes 304 with fins on outer layers, with plastic coatings and with insection on inner walls may be selected according to actual conditions. The radiation assemblies 30 may be radiation ground, radiation walls or radiation ceilings, and different combinations of radiation assemblies may be selected according to actual conditions.

It should be noted that in order to tell parts in different pipelines, they are distinguished on the basis of the corresponding parts (marking symbols are added behind corresponding numbers for distinction), including but not limited to: the distributor connection outlets 306 and the distributor connection outlets 306'.

According to some embodiments of the application, electromagnetic valves 420 are further arranged in the air conditioner/heat pump expansion function box, the radiation assemblies comprise a first radiation assembly group and a second radiation assembly group, the first radiation assembly group and the second radiation assembly group each comprise at least one radiation unit, one second-level branch pipe of the second-level manifold pipe of each distribution pipeline may be connected with the first radiation assembly group, and the other second-level branch pipe of the second-level manifold pipe may be connected with the second radiation assembly group. In order to facilitate distinguishment, the two distribution pipelines are the first distribution pipeline and the second distribution pipeline correspondingly, the second-level branch pipes, used for being connected with the first radiation assembly group, of the first distribution pipeline are connected with output ends of the electromagnetic valves, and the second-level branch pipes, used for being connected with the second radiation assembly group, of the second distribution pipeline are connected with input ends of the electromagnetic valves. Equivalently, as shown in FIG. 9, a serial pipeline is arranged in the air conditioner/heat pump expansion function box, one end of the serial pipeline is connected with one second-level branch pipe of the second-level manifold pipe F2 of the first distribution pipeline (a manifold pipe 510 is arranged on the second-level branch pipe of the second-level manifold pipe F2, and one branch pipe of the manifold pipe 510 is used for being connected with the serial pipeline), the other end of the serial pipeline is connected with one second-level branch pipe (the other branch pipe of the second-level manifold pipe F2' is used for being connected with the first radiation assembly group) of the second-level manifold pipe F2' of the second distribution pipeline (a manifold pipe 520 is arranged on the second-level branch pipe, and one branch pipe of the manifold pipe is used for being connected with the serial pipeline), and after the first distribution pipeline and the second distribution pipeline are connected with the first radiation assembly group and the second radiation assembly group, serial connection of the first radiation assembly group and the second radiation assembly group may be achieved through opening of the electromagnetic valves 420 under the preset condition of the serial pipeline.

In some other embodiments of the application, the first radiation assembly group may internally comprise a plurality of radiation units (under the condition, equivalently, each distribution pipeline internally comprises third-level manifold pipes or fourth-level manifold pipes or other multi-level manifold pipes (not limited to the third-level manifold pipes and the fourth-level manifold pipes), the first auxiliary assembly group communicates with lower-level manifold pipes (refer to manifold pipes below the second level, such as the third-level manifold pipes) on a pipeline of one second-level branch pipe of the second-level manifold pipe, the plurality of radiation units of the first radiation assembly group are connected in series or parallel (refer to the connection mode of the above serial pipeline), when the plurality of radiation units of the first radiation assembly group need to be connected in series, corresponding valves are closed, and in a normal state, the plurality of radiation units of the first radiation assembly group are connected in parallel. It should be noted that the second radiation assembly group also may comprise a plurality of radiation units (the number may be different from the number of the radiation units of the first radiation assembly group, for example, some lower-level manifold pipes are not connected with the radiation units), and the connection mode of the plurality of radiation units of the second radiation assembly group refers to the connection mode of the first radiation assembly group. Implementation of serial and parallel connection of the radiation assemblies solves the problem that "water-free floor heating" pipelines are not variable in length and may not serve as heat exchangers in the air conditioner/heat pump heat storage refrigeration system to change along with environmental temperature, and further promotes the reasonability of combination of radiation heat exchange bodies and buildings, so that application of "thy-type water-free floor heating" becomes possible.

Figure 10:
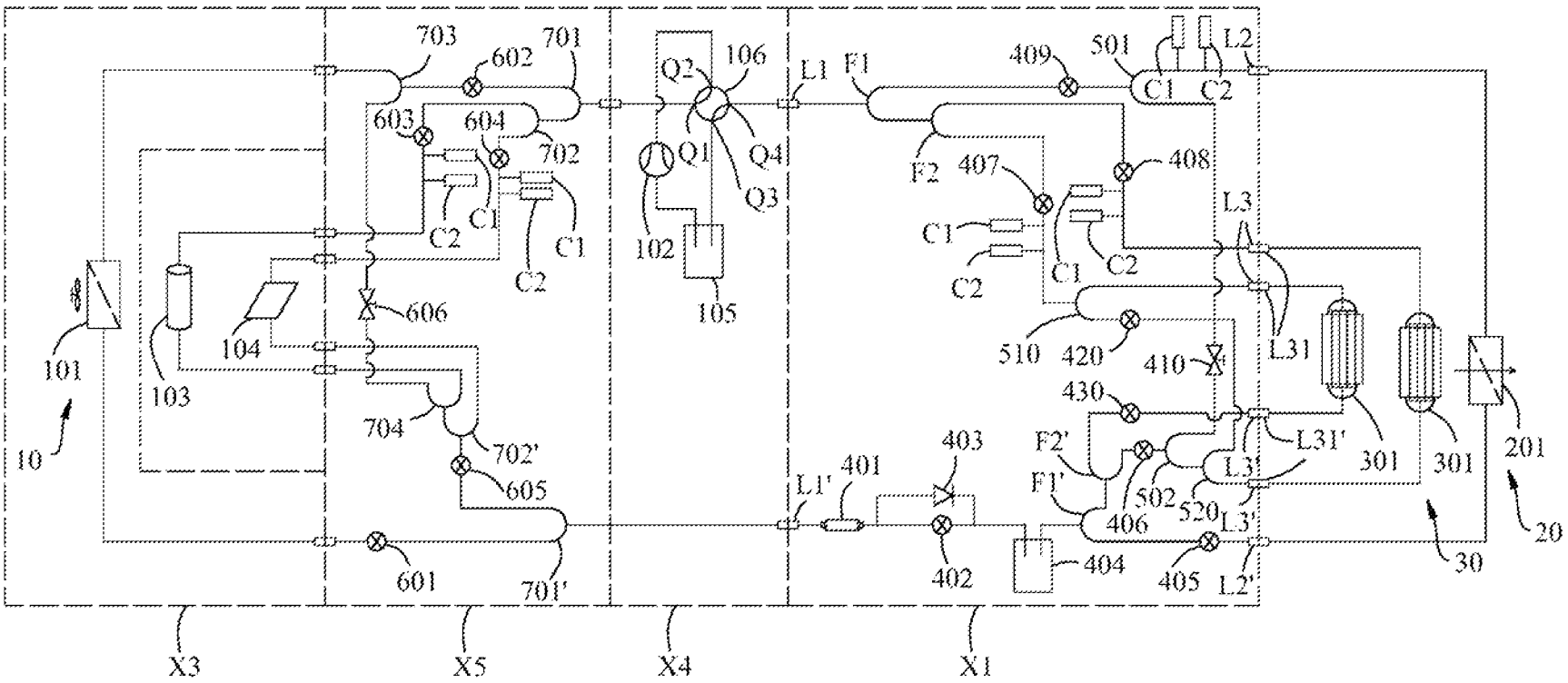
FIG. 10 is a connection structure schematic diagram of a radiation assembly of an air conditioner/heat pump heat storage refrigeration system.

As shown in FIG. 10, manifold pipes (manifold pipe 510 and manifold pipe 520) are additionally arranged at the front ends and the rear ends of the two different radiation assembly groups correspondingly, one of four branch paths formed by the two manifold pipes (manifold pipe 510 and manifold pipe 520) is switched on (one radiation assembly group is connected), an electromagnetic valve (electromagnetic valve 420) is connected between the two manifold pipes, an expansion valve 430 is additionally arranged at one end of the other radiation assembly group, and the purpose that lengths (radiation area) and inner volumes of heat exchange pipes in the radiation assembly groups may be matched with the unit to be variable according to the requirements of system working conditions may be achieved. When temperature (and pressure) change of the radiation assembly groups reaches a certain value, in other words, the temperature change does not meet the requirements of the system working conditions, the radiation assembly groups must be added in a serial or parallel mode (or the radiation assembly groups are reduced), and therefore the two radiation assembly groups may be connected in series through opening of the electromagnetic valve 420 on a communication pipeline. For example: During heating, refrigerant (the flowing process before the refrigerant enters the radiation assembly groups is omitted) flows into the second-level manifold pipe F2, flows into one radiation assembly group through the expansion valve 408, then flows through the manifold pipe 520, the electromagnetic valve 420 and the manifold pipe 510 (the expansion valve 406 and the expansion valve 407 are closed at the moment), then flows into the other radiation assembly group, then flows through the second-level manifold pipe F2' and the first-level manifold pipe F1' through the expansion valve 430, and flows into the liquid storage tank 404 (the flowing process after the refrigerant flows out of the radiation assembly groups is omitted); and during refrigeration, the refrigerant flows into the first-level manifold pipe F1', the second-level manifold pipe F2' and the expansion valve 430 from the liquid storage tank 404, then flows through the manifold pipe 510, then flows into the manifold pipe 520 (the expansion valve 406 and the expansion valve 407 are closed) through the electromagnetic valve 420, then flows into one radiation assembly group, then flows through the manifold pipe F2 and the manifold pipe F1, and flows into the four-way valve (omit). Whether refrigeration or heating is carried out, if the radiation assembly groups need to be connected in parallel, the electromagnetic valve 420 is closed, then the expansion valves at the front (rear) end of each radiation assembly group are opened (or closed). In addition, correspondingly-cooperative tools of different structures should be carried out on pipe diameters, pipe lengths, pipe intervals and pipe positions (ground, walls and ceilings) of the heat exchange pipes of the radiation assembly group completing "variable" cooperatively.

Figure 9:
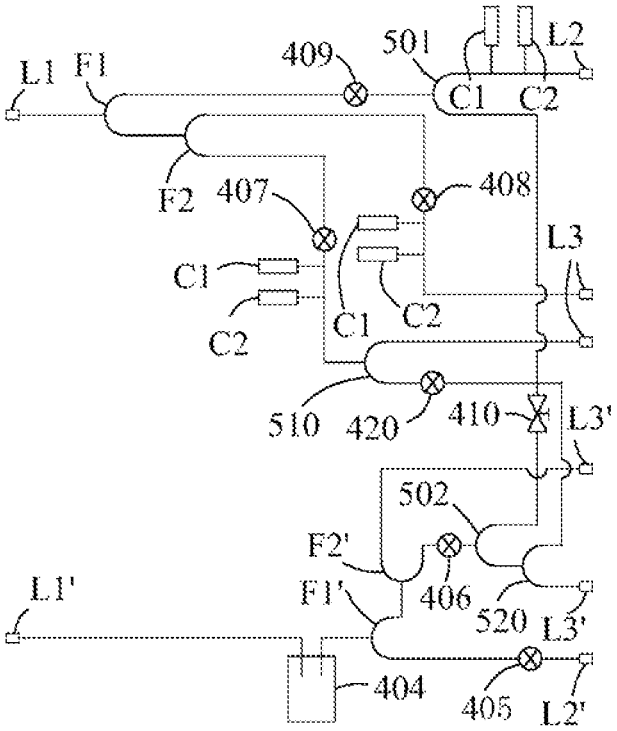
FIG. 9 is the fifth structural schematic diagram of an air conditioner/heat pump expansion function box in FIG. 1.

In some specific embodiments of the application, as shown in FIG. 1 and FIG. 9, in order to achieve serial and parallel connection of the radiation assemblies 30 and the indoor unit 20, a first adjusting pipe is further arranged in the air conditioner/heat pump expansion function box, a manifold pipe 501 is connected to one first-level branch pipe of the first-level manifold pipe F1 forming one main path G1 of one distribution pipeline, a main pipe of the manifold pipe 501 communicates with the first-level branch pipe, the end portion of one branch pipe of the manifold pipe 501 is provided with an indoor unit nut head L2, and the other branch pipe of the manifold pipe 501 communicates with one end of the first adjusting pipeline; and a manifold pipe 502 is connected to the first-level branch pipe forming the first-level branch path of the other distribution pipeline, a main pipe of the manifold pipe 502 communicates with the first-level branch pipe, and two branch pipes of the manifold pipe 502 are connected with a main pipe of the second-level manifold pipe F2' and the other end of the first adjusting pipeline. Equivalently, the first adjusting pipeline communicates with the main path in one distribution pipeline and the first-level branch path in the other distribution pipeline, a first adjusting stop valve 410 is arranged on the first adjusting pipeline, and the radiation assemblies 30 and the indoor unit 20 are connected in series or parallel through opening or closing of the first adjusting stop valve 410. The first adjusting stop valve 410 may be closed, return gas temperature of compressors 102 is controlled by means of controllable opening of the expansion valve 409 and in combination with frequency conversion of the inner heat exchangers 201, so that the whole machine energy efficiency is further improved.

Figure 11:
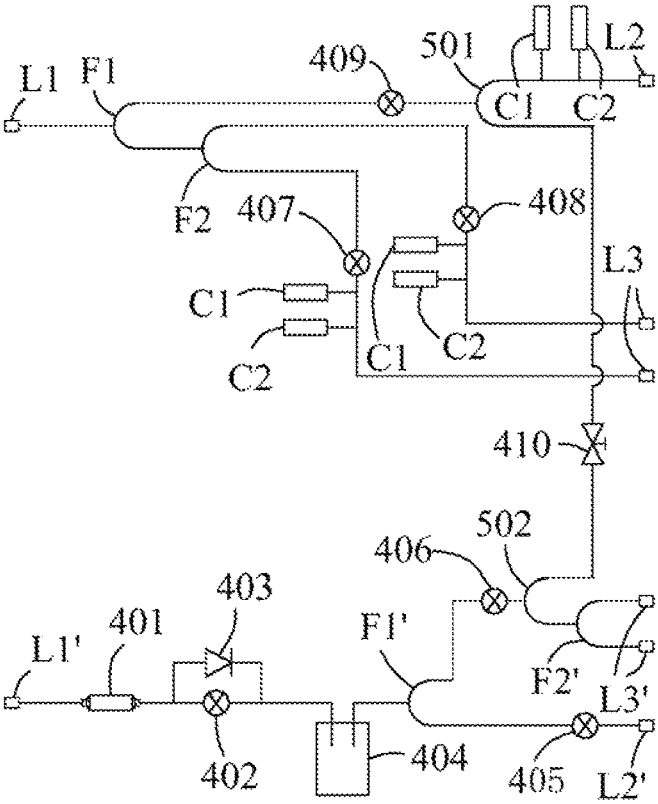
FIG. 11 is the sixth structural schematic diagram of an air conditioner/heat pump expansion function box in FIG. 1.

Optionally, as shown in FIG. 11, a dryer 401 and a throttle part 402 are arranged in one distribution pipeline, the throttle part 402 may be an electronic expansion valve (pressure expansion valve) or a capillary pipe and is used for adjusting the flow of the refrigerant in the system pipelines (during heating), and the dryer 401 is used for dehumidifying the pipelines and filtering out impurities. In order to reasonably use the throttle part 402, a one-way valve 403 is connected beside the throttle part in parallel, during heating (the one-way valve 403 is in a reverse closing state), the refrigerant in the system pipelines may only flow through the throttle part 402, and during refrigeration (the throttle part 402 is closed), the refrigerant in the system pipelines may only flow through the one-way valve 403.

According to some embodiments of the application, as shown in FIG. 1, the outdoor unit 10 comprises outer heat exchangers 101, the compressors 102 and a four-way valve 106 connected with the compressors 102, outlet ends of the outer heat exchangers 101 are connected with a first port Q1 of the four-way valve 106, inlet ends of the outer heat exchangers 101 are connected with one outdoor unit nut head L1, a second port Q2 of the four-way valve 106 communicates with outlet ends of the compressors 102, inlet ends of the compressors 102 are connected with a third port Q3 of the four-way valve 106, and a fourth port Q4 of the four-way valve 106 is connected with the other indoor unit nut head L1; when the air conditioner/heat pump heat storage refrigeration system 1 is in a refrigeration mode, the first port Q1 of the four-way valve 106 communicates with the second port Q2, and the third port Q3 communicates with the fourth port Q4; when the air conditioner/heat pump heat storage refrigeration system 1 is in a heating mode, the first port Q1 of the four-way valve 106 communicates with the third port Q3, and the second port Q2 communicates with the fourth port Q4; The indoor unit 20 comprises inner heat exchangers 201, inlet ends of the inner heat exchangers 201 are connected with one indoor unit nut head L2, and outlet ends of the inner heat exchangers are connected with the other indoor unit nut head L2'. In order to remove liquid in gas entering the compressors 102, gas-liquid separators 105 are arranged at the inlet ends of the compressors 102. It should be noted that the outlet ends and the inlet ends of the outer heat exchangers 101 are two ports of the outer heat exchangers 101 and are used for being connected with other parts correspondingly, the outlet ends are not the outlet of the flowing medium, and may be the inlet of the flowing medium, and the principle of the inlet ends is similar to that of the outlet ends.

In the embodiment, the four-way valve 106, the compressors 102 and the outer heat exchangers 101 are located in one box body, the box body is connected with two ports used for being connected with the two outdoor unit nut heads L1 of the air conditioner/heat pump expansion function box correspondingly, and the structure is compact. It should be noted that in some embodiments of the application, the compressors 102 may be gas filling enthalpy increase compressors, the gas filling enthalpy increase compressors adopt a two-level throttle middle gas spraying technology, gas-liquid separation is carried out through flash evaporators, and therefore the enthalpy increase effect is achieved. The displacement of the compressors may be increased, and the purpose of improving heating capacity under the condition of the low-temperature environment is achieved. In other embodiments of the application, the compressors 102 may be integrated multi-cylinder compressors, or the number of compressors 102 is at least two, and different forms or combinations of compressors 102 may be selected according to different working condition requirements.

Optionally, the number of the inner heat exchangers 201 may be two, the two inner heat exchangers 201 are connected to a refrigerant loop of the system in parallel, equivalently, in the expansion function box bodies X1, one manifold pipe is connected to the first-level branch pipe forming the main path in one distribution pipeline, the main pipe of the manifold pipe communicates with the first-level branch pipe, the end portions of the two branch pipes of the manifold pipe are connected with the indoor unit nut heads L2 correspondingly, and therefore the two inner heat exchangers 201 are connected with the air conditioner/heat pump expansion function box. In other embodiments of the application, the number of the inner heat exchangers 201 may be multiple, and it is only needed to connect the plurality of distributors with the refrigerant loop in parallel on the first-level branch pipes and then connect the plurality of inner heat exchangers 201 in parallel. It should be noted that the indoor unit 20 further comprises humidity sensors (not shown in Figures), the humidity sensors are electrically connected with the control circuit board and used for detecting indoor humidity, generating humidity signals, sending the humidity signals to the control circuit board, carrying out analysis according to the humidity signals and controlling the inner heat exchangers 201 to participate in dehumidification or humidification.

Optionally, the inner heat exchangers 201 of the indoor unit 20 may be air conditioner indoor units, also may be fresh air units (not shown in Figures), and further may be combinations of the fresh air units and the air conditioner indoor units, when the air conditioner indoor units carry out temperature heat exchange for indoor space, the fresh air units carry out humidity exchange, air purification and the like on indoor air, the diversity of functions of the air conditioner/heat pump heat storage refrigeration system is improved, and meanwhile more energy-saving and comfortable environmental experience is provided. In order to better improve and promote the quality of the indoor air, purifiers, humidifiers, negative (oxygen) ion generators, photocatalyst coating generation cavities and the like may be added in the fresh air units.

Figure 12:
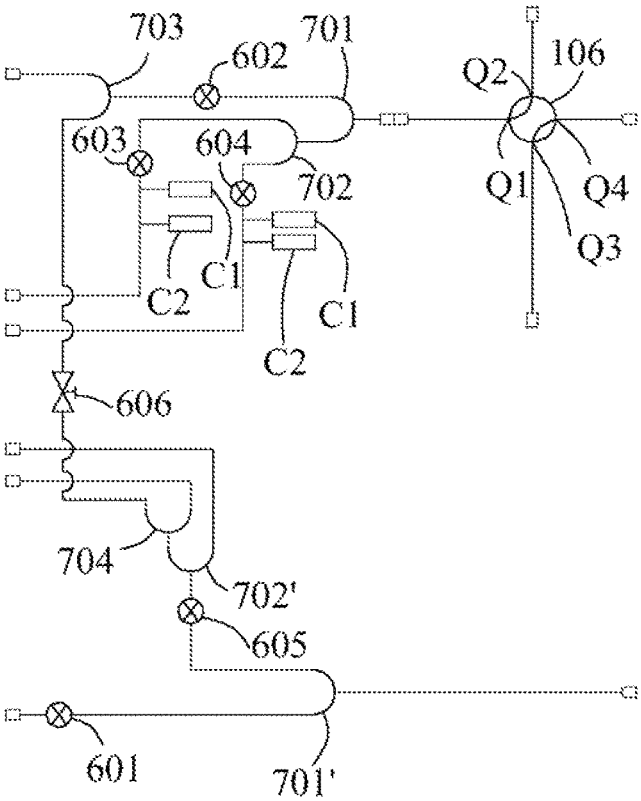
FIG. 12 is a structural schematic diagram of an auxiliary function box of an air conditioner/heat pump heat storage refrigeration system.
Figure 13:
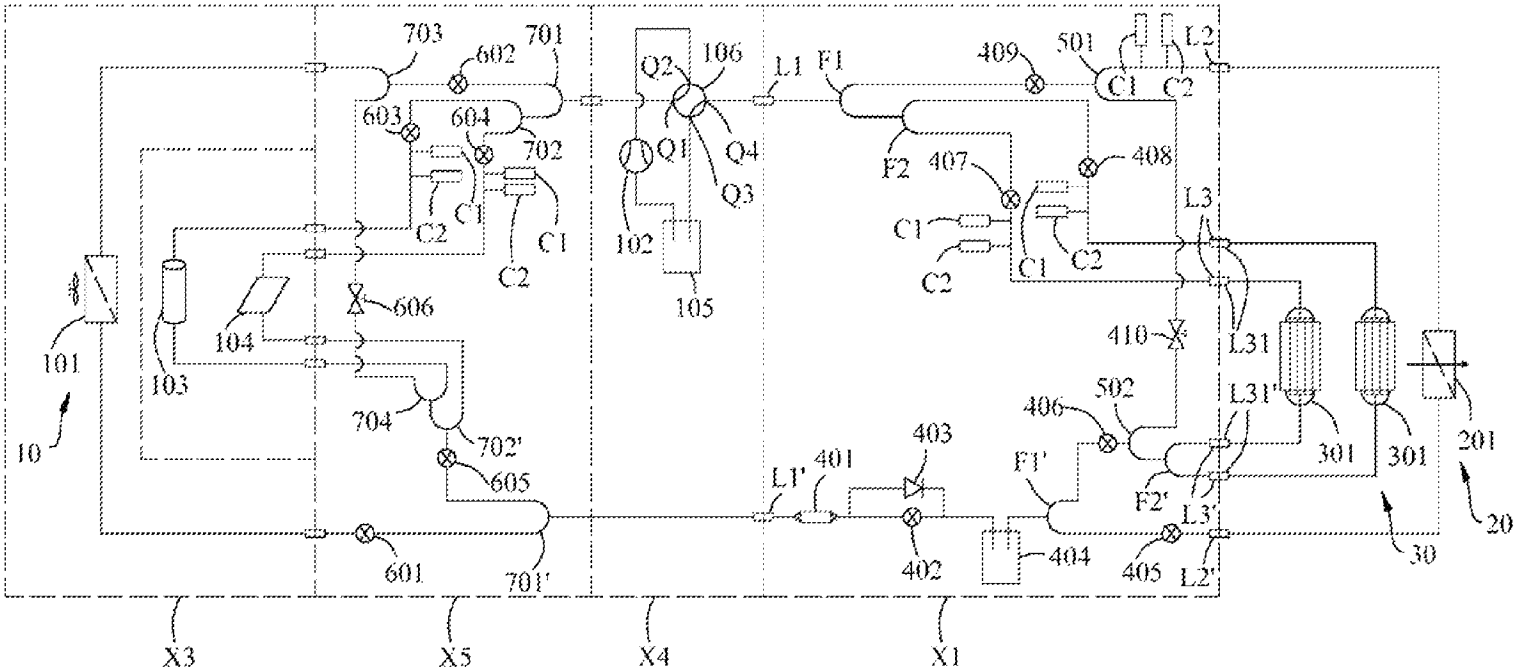
FIG. 13 is the second structural schematic diagram of an air conditioner/heat pump heat storage refrigeration system of the embodiments of the application.

According to some embodiments of the application, the air conditioner/heat pump heat storage refrigeration system 1 further comprises a water heater 103, an illumination assembly 104 and an auxiliary function box, as shown in FIG. 12 and FIG. 13, the auxiliary function box comprises an auxiliary function box body X5 and two auxiliary pipelines located in the auxiliary function box body X5, and each auxiliary pipeline comprises a first-level auxiliary manifold pipe (manifold pipe 701 and manifold pipe 701') and a second-level auxiliary manifold pipe (manifold pipe 702 and manifold 702'). Each of the first-level auxiliary manifold pipe and the second-level auxiliary manifold pipe comprises a main pipe and two branch pipes, the main pipe of the second-level auxiliary manifold pipe is connected with one branch pipe of the first-level auxiliary manifold pipe, the end portion of the main pipe of the first-level auxiliary manifold pipe is connected with an auxiliary inlet end, and the end portion of the other branch pipe of the first-level auxiliary manifold pipe and the end portions of the two branch pipes of the second-level auxiliary manifold pipes are provided with auxiliary outlet ends correspondingly; the two auxiliary pipelines of the auxiliary function box are the first auxiliary pipeline (a pipeline formed by the manifold pipe 701 and the manifold pipe 702) and the second auxiliary pipeline (a pipeline formed by the manifold pipe 701' and the manifold pipe 702') correspondingly, the auxiliary inlet end (the end portion of the main pipe of the manifold pipe 701) of the first auxiliary pipeline is connected with the first port Q1 of the four-way valve 106, the three auxiliary outlet ends (one branch pipe of the manifold pipe 703 and two branch pipes of the manifold pipe 702) of the first auxiliary pipeline are connected with the outlet ends of the outer heat exchangers, the outlet end of the water heater 103 and the outlet end of the illumination assembly 104 correspondingly, the auxiliary inlet end (the end portion of the main pipe of the manifold pipe 701') of the second auxiliary pipeline is connected with the outdoor unit nut head L1' corresponding to the inlet ends of the outer heat exchangers 101, and the three auxiliary outlet ends (one branch pipe of the manifold pipe 701', one branch pipe of the manifold pipe 702' and one branch of the manifold pipe 704) of the second auxiliary pipeline are connected with the inlet ends of the outer heat exchangers, the inlet end of the water heater 103 and the inlet end of the illumination assembly 104 correspondingly; and the auxiliary function box is further internally provided with a second adjusting pipeline, one end of the second adjusting pipe communicates with the branch pipe (the branch pipe provided with the manifold pipe 703, namely one branch pipe of the manifold pipe 703), provided with the auxiliary outlet end, of the first-level auxiliary manifold pipe of the first auxiliary pipeline, the other end of the second adjusting pipe communicates with one branch pipe (the other branch pipe of the manifold pipe 704) of the second-level auxiliary manifold pipe (manifold pipe 702') of the second auxiliary pipeline, the second adjusting pipeline is provided with a second adjusting stop valve 606, and the second adjusting stop valve 606 is used for controlling on or off of the second adjusting pipeline in order to change serial and parallel modes of the outer heat exchangers 101, the water heater 103 and the illumination assembly 104. FIG. 13 shows a structural schematic diagram of an auxiliary function box. The outlet ends and the inlet ends of the water heaters 103 are two ports of the water heaters 103 and are used for being connected with other parts correspondingly, the outlet ends are not the outlet of the flowing medium, and may be the inlet of the flowing medium, and the principle of the inlet ends is similar to that of the outlet ends. Principles of the outlet end and the inlet end of the illumination assembly 104 are the same as those of the outlet end and the inlet end of the water heater 103.

Figure 14:
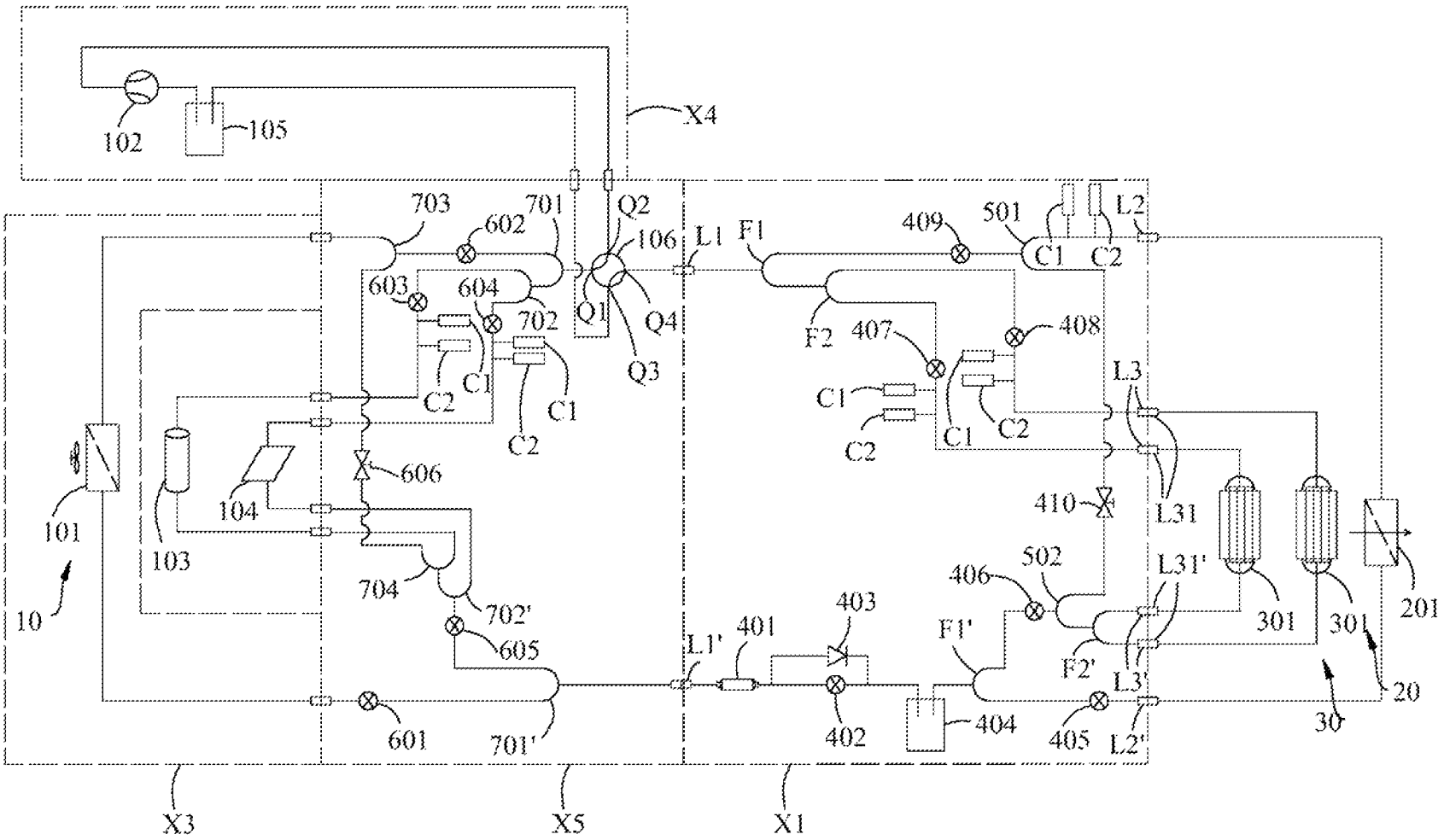
FIG. 14 is the third structural schematic diagram of an air conditioner/heat pump heat storage refrigeration system of the embodiments of the application.

It should be noted that in the above mode, due to the arrangement of the auxiliary function box, the compressors 102 are separated from the outer heat exchangers 101, the compressors and the outer heat exchangers are not located in the same box body, the compressors 102 are located in a compressor box body X4, the outer heat exchangers 101 are located in an outer heat exchanger box body X3, and heat exchange of the outer heat exchangers 101 is facilitated (the same as the inner heat exchangers 201, the number of the outer heat exchangers 101 also may be two or more, which is not shown in Figures). As shown in FIG. 13, the four-way valve 106 is located in the compressor box body X4 in order to facilitate heat exchange of the outer heat exchangers 101. During system assembly, it is only needed to connect ports of the outdoor unit nut head L1, the outdoor unit nut head L1', the outer heat exchangers 101, the compressors 102, the water heater 103 and the illumination assembly 104. As shown in FIG. 14, the positions of the compressors 102 may be independently arranged, at the moment, the four-way valve 106 is located in the auxiliary function box body X5, and the compressor box body X4 is provided with two ports communicating with the second port Q2 and the third port Q3 of the four-way valve 106 in the auxiliary function box body X5 correspondingly; the auxiliary function box body X5 is provided with eight ports, the first auxiliary pipeline is provided with five ports, and two ports used for being connected with the compressors 102 are added relative to three ports of the second auxiliary pipeline; and the compressors 102 are independently arranged in one box body (compressor box body X4), so that fixing, noise reduction, replacement and maintenance of the compressors 102 are conveniently achieved, meanwhile, the placement positions of the compressors 102 are more flexible, the compressors may be placed indoors (unfrozen positions) and also may be placed in outdoor certain corners (without considering ventilation).

Optionally, in some embodiments of the application, the water heater 103 is an air energy water heater with an electric auxiliary function, so that "two-way" automatic heating is facilitated. The shape of the illumination assembly 104 may be prolate, the width size of the mode is large, the occupied installation space is large, and the illumination assembly is used for being installed on a roof or a balcony; the illumination assembly also may be long flat, the width size of the shape is small, the occupied installation space is small, and the illumination assembly is used for being installed between the roof and two windows; As for the type of illumination assembly 104 adopted, during installation, the illumination assembly 104 must have a certain inclination angle, but the inclination angle is not too large, and it is better that solar energy is conveniently absorbed in winter while buildings are not affected.

As the outer heat exchangers 101 are independently located in the outer heat exchanger box body X3, the outer heat exchangers have "enough" heat exchange space, and a heat exchange function is affected to a certain degree by different shapes of the outer heat exchangers 101. Optionally, the shapes of the outer heat exchangers 101 are conical, round, oval and the like, and the heat exchange capacity of the outer heat exchangers 101 is improved due to the uniform heat exchange area of the outer heat exchangers. In other embodiments of the application, the shapes of the outer heat exchangers 101 also may be L-shaped, rectangular, special-shaped and the like.

Figure 15:
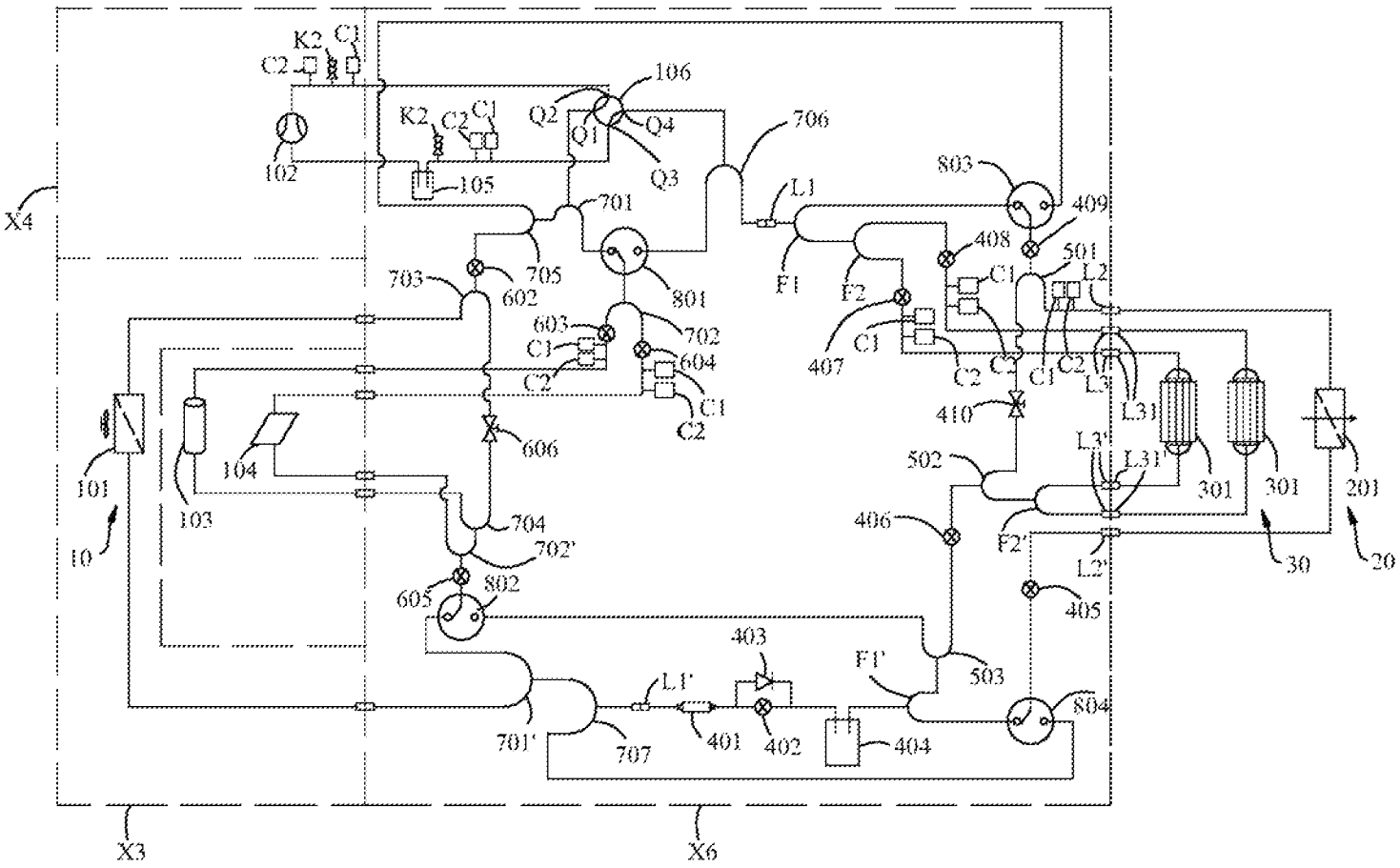
FIG. 15 is the fourth structural schematic diagram of an air conditioner/heat pump heat storage refrigeration system of the embodiments of the application.

According to some embodiments of the application, in order to reasonably utilize installation space, parts of the auxiliary function box and the air conditioner/heat pump expansion function box are combined in the same box body to form a composite function box, as shown in FIG. 15. Due to the arrangement of the composite function box, all the parts are integrated in a composite function box body X6, a plurality of connectors are arranged and used for connection with the compressors 102, the outer heat exchangers 101, the inner heat exchangers 201, the radiation assemblies 30, the water heater 103 and the illumination assembly 104, the assembly efficiency is improved, and during system assembly, the influence of welding and other processes on installation quality is reduced. According to the composite function box, on the basis of combination of the auxiliary function box and the air conditioner/heat pump expansion function box, three-way valves and manifold pipes are added, so that a plurality of different working conditions are conveniently achieved.

In the above embodiment, the compressors 102 are arranged outside the composite function box and located in the independent box body (compressor box body X4), the pressure sensors C1, the temperature sensors C2 and the service valves K2 are arranged at output ends (high-pressure ends) and input ends (low-pressure ends) of the compressors 102, pressure or temperature of the refrigerant entering pipelines of the compressors 102 may be monitored, and the compressors 102 are conveniently overhauled or replaced. The pressure sensors C1, the temperature sensors C2 and the service valves K2 at the low-pressure ends of the compressors 102 are located in the compressor box body X4, and the pressure sensors C1, the temperature sensors C2 and the service valves K2 at the high-pressure ends of the compressors 102 are located in the composite function box body X6. In other embodiments of the application, the positions of the pressure sensors C1, the temperature sensors C2 and the service valves K2 at the low-pressure ends and the high-pressure ends may be diverse, for example, the pressure sensors C1, the temperature sensors C2 and the service valves K2 at the low-pressure ends and the high-pressure ends are all located in the compressor box body X4, or the pressure sensors C1, the temperature sensors C2 and the service valves K2 at the low-pressure ends and the high-pressure ends are all located in the composite function box body X6, and different installation positions may be selected according to actual conditions.

It should be noted that all pipelines bearing the refrigerant "penetrate through" the water heater 103 and the illumination assembly 104, the water heater 103 may heat water through electricity, and the illumination assembly 104 may heat the box body through solar energy. When the temperature of the refrigerant entering the water heater is high, water in the water heater 103 may also be heated; and similarly, the refrigerant in the box body is correspondingly heated after the box body of the illumination assembly 104 is heated through the solar energy.

In the application, the control circuit board is electrically connected with all electrical parts in the whole system and used for controlling working states of all the electrical parts.

The working principle of the air conditioner/heat pump heat storage refrigeration system 1 according to the embodiment is described below in combination with attached figures.

Figure 16:
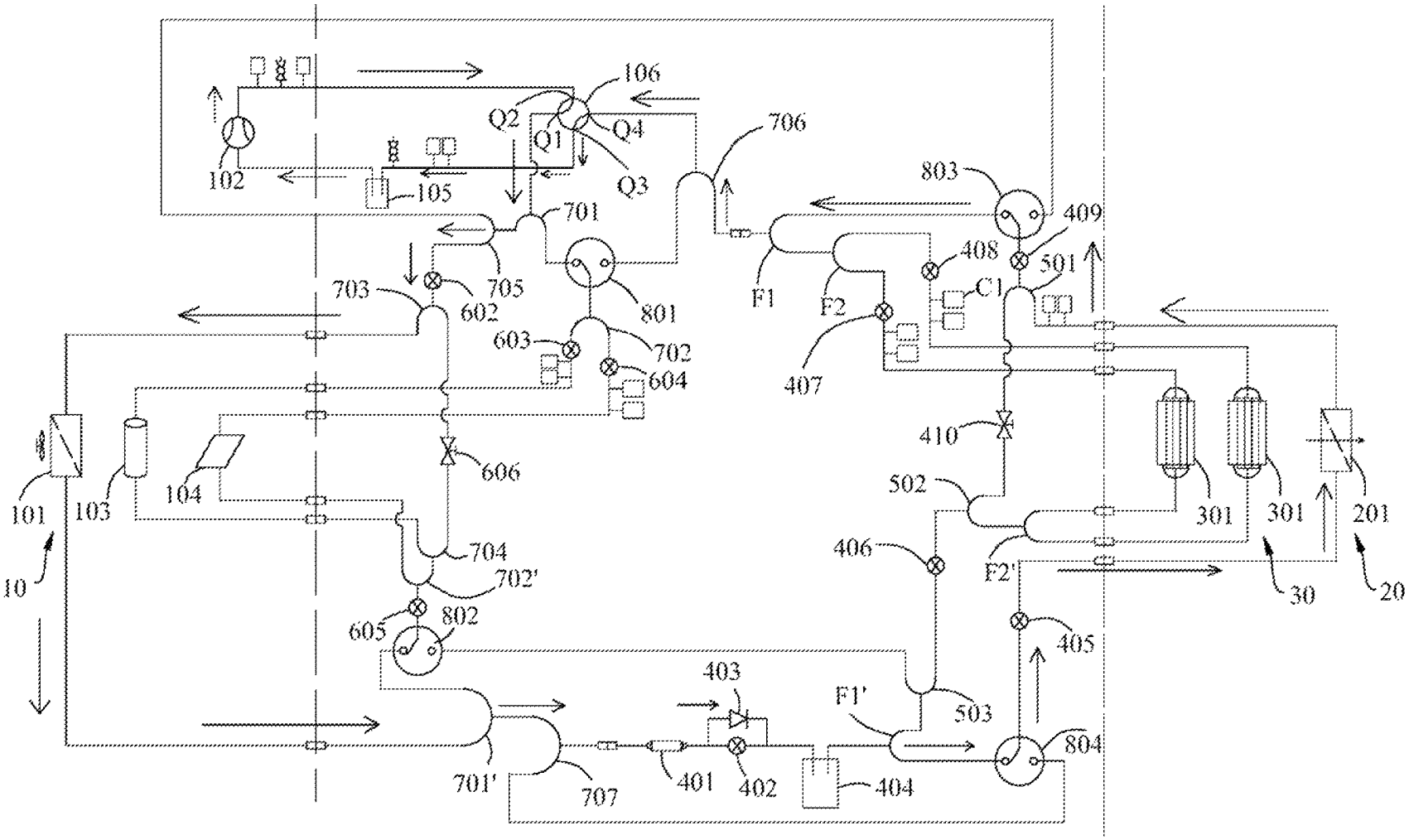
FIG. 16 is the refrigerant flow diagram of the first refrigeration/dehumidification state of an air conditioner/heat pump heat storage refrigeration system.

The first refrigeration state of the air conditioner/heat pump heat storage refrigeration system 1: As shown in FIG. 16, in the first refrigeration state, the indoor unit 20 participates in refrigeration, and the radiation assemblies 30, the water heater 103 and the illumination assembly 104 do not work. In the state, the first port Q1 of the four-way valve 106 communicates with the second port Q2, the third port Q3 communicates with the fourth port Q4, and the refrigerant flowing process is as follows: the refrigerant flows out from the output ends of the compressors 102, sequentially flows through the four-way valve 106 (flow in from the second port Q2 and flow out from the first port Q1), the manifold pipe 701, the manifold pipe 705, the expansion valve 602 and the manifold pipe 703, flows into the outer heat exchangers 101, is output to the manifold pipe 701', the manifold pipe 707, the dryer 401, the one-way valve 403, the liquid storage tank 404, the first-level manifold pipe F1', the three-way valve 804 (first position, communicate with the first-level manifold pipe F1'), the expansion valve 405, the inner heat exchangers 201, the manifold pipe 501, the expansion valve 409, the three-way valve 803 (first position, communicate with the first-level manifold pipe F1), the first-level manifold pipe F1, the manifold pipe 706, the four-way valve 106 (flow in from the fourth port Q4 and flow out from the third port Q3) and the gas-liquid separators 105 from the outer heat exchangers 101, and returns to the input ends of the compressors 102. In the state, the inner heat exchangers 201 are evaporators, and the outer heat exchangers 101 are condensers. It should be noted that in the state, valves not mentioned are all in a closed state, the three-way valve 801 is located in the first position (communicate with the manifold pipe 701), and the three-way valve 802 is located in the first position (communicate with the manifold pipe 701').

Figure 17:
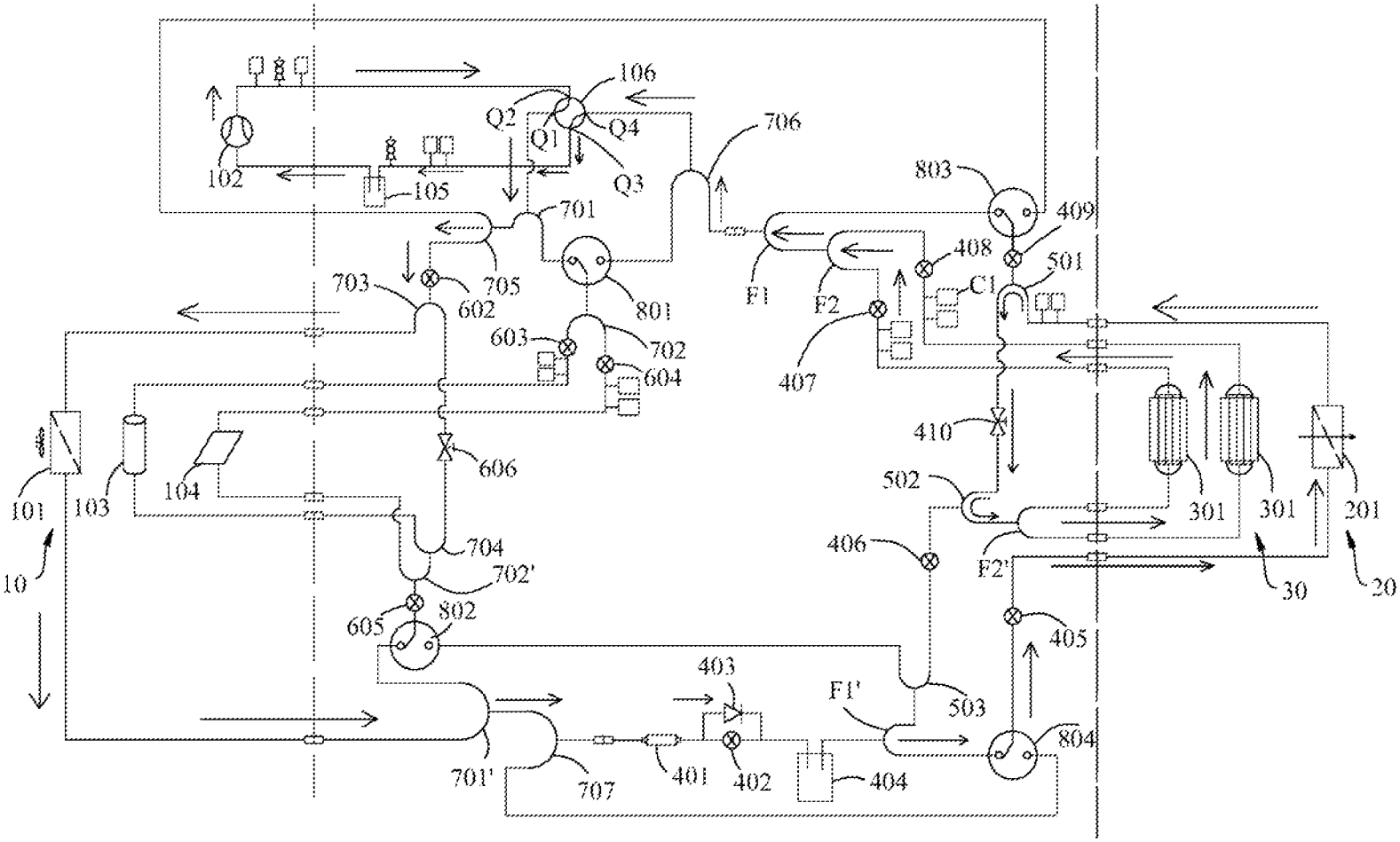
FIG. 17 is the refrigerant flow diagram of the second refrigeration/dehumidification state of an air conditioner/heat pump heat storage refrigeration system.

The second refrigeration state of the air conditioner/heat pump heat storage refrigeration system 1: As shown in FIG. 17, in the second refrigeration state, the indoor unit 20 and the radiation assemblies 30 participate in refrigeration in series, the water heater 103 and the illumination assembly 104 do not work. In the state, the first port Q1 of the four-way valve 106 communicates with the second port Q2, the third port Q3 communicates with the fourth port Q4, and the refrigerant flowing process is as follows: the refrigerant flows out from the output ends of the compressors 102, sequentially flows through the four-way valve 106 (flow in from the second port Q2 and flow out from the first port Q1), the manifold pipe 701, the manifold pipe 705, the expansion valve 602 and the manifold pipe 703, flows into the outer heat exchangers 101, is output to the manifold pipe 701', the manifold pipe 707, the dryer 401, the one-way valve 403, the liquid storage tank 404, the first-level manifold pipe F1', the three-way valve 804 (first position), the expansion valve 405, the inner heat exchangers 201, the manifold pipe 501, the first adjusting stop valve 410, the manifold pipe 502, the second-level manifold pipe F2', the radiation assemblies 30 (the radiation unit 301, the expansion valve 407 or the expansion valve 408), the second-level manifold pipe F2, the first-level manifold pipe F1, the manifold pipe 706, the four-way valve 106 (flow in from the fourth port Q4 and flow out from the third port Q3) and the gas-liquid separators 105 from the outer heat exchangers 101, and returns to the input ends of the compressors 102. In the state, the outer heat exchangers 101 are condensers, the inner heat exchangers 201 and the radiation assemblies 30 form evaporators, the inner heat exchangers 201 are evaporator front sections, the radiation assemblies 30 are evaporator rear sections, the temperature of the evaporator front sections is low (usually the temperature is lower than 15° C., dew formation is easy, and dehumidification may be considered), the temperature of the rear sections is slightly high (usually the temperature is higher than 18° C., dew points may be avoided, and refrigeration is carried out in "intermediate temperature" sections), dehumidification is carried out while refrigeration is achieved, the return gas temperature of the compressors 102 is controlled through closing of the first adjusting stop valve 410, controllable opening of the expansion valve 409 and frequency conversion of the inner heat exchangers 201, and the whole machine energy efficiency is further improved. It should be noted that in the state, valves not mentioned are all in a closed state, the three-way valve 801 is located in the first position, the three-way valve 802 is located in the first position, and the three-way valve 803 is located in the first position.

Figure 18:
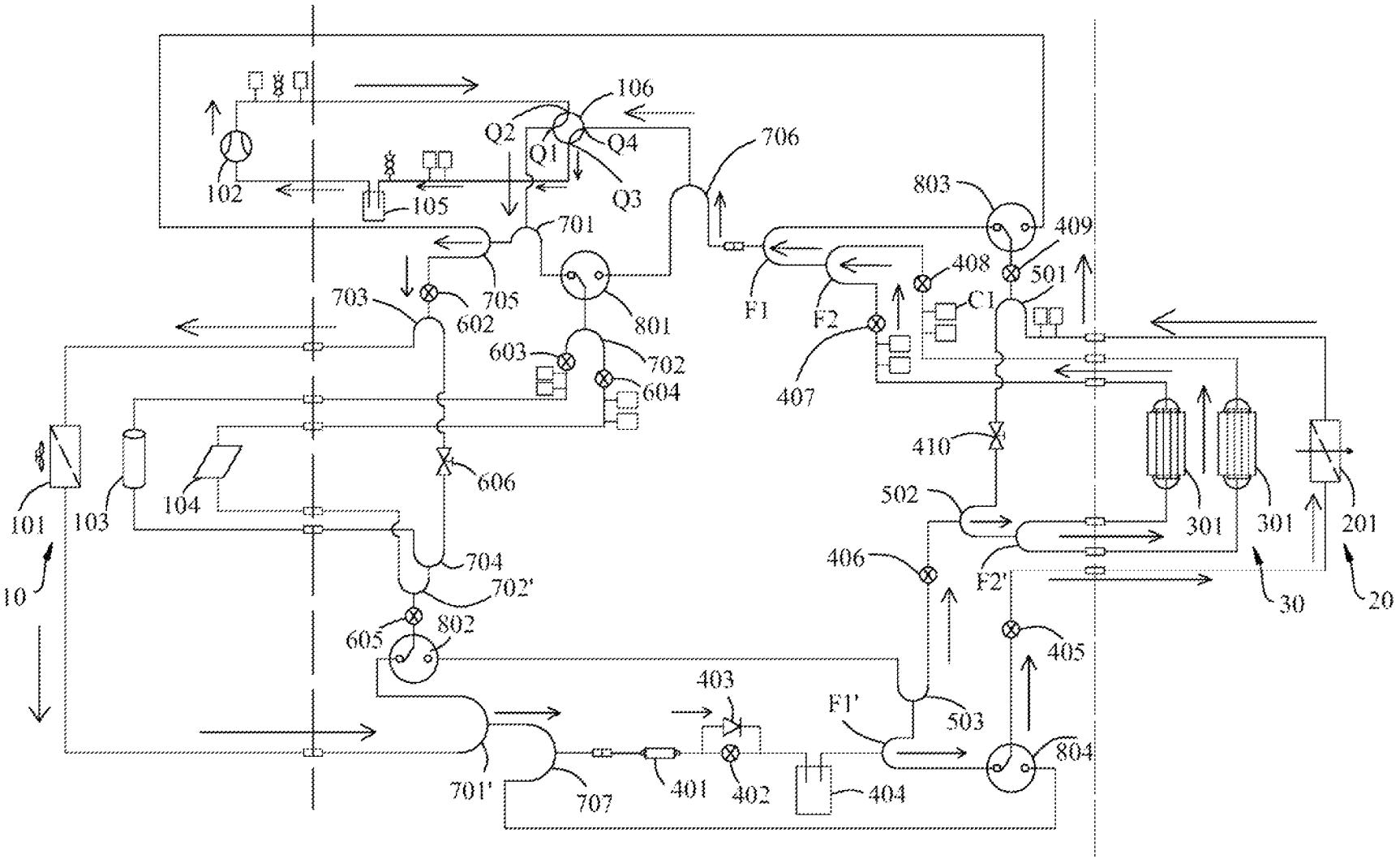
FIG. 18 is the refrigerant flow diagram of the third/fourth refrigeration state of an air conditioner/heat pump heat storage refrigeration system.

The third refrigeration state of the air conditioner/heat pump heat storage refrigeration system 1: As shown in FIG. 18, in the third refrigeration state, the indoor unit 20 and the radiation assemblies 30 participate in refrigeration in parallel, the water heater 103 and the illumination assembly 104 do not work. In the state, the first port Q1 of the four-way valve 106 communicates with the second port Q2, the third port Q3 communicates with the fourth port Q4, and the refrigerant flowing process is as follows: The refrigerant flows out from the output ends of the compressors 102, sequentially flows through the four-way valve 106 (flow in from the second port Q2 and flow out from the first port Q1), the manifold pipe 701, the manifold pipe 705, the expansion valve 602 and the manifold pipe 703, flows into the outer heat exchangers 101, is output to the manifold pipe 701', the manifold pipe 707, the dryer 401, the one-way valve 403 and the liquid storage tank 404 from the outer heat exchangers 101, and flows into the first-level manifold pipe F1', the refrigerator is divided into two branch paths at the first-level manifold pipe F1', one branch path flows through the three-way valve 804 (first position), the expansion valve 405, the inner heat exchangers 201, the manifold pipe 501, the expansion valve 409 and the three-way valve 803 (first position), and flows into the first-level manifold pipe F1, the other branch path flows through the manifold pipe 503, the expansion valve 406, the manifold pipe 502, the second-level manifold pipe F2', the radiation assemblies 30 (the radiation units 301, the expansion valve 407 or the expansion valve 408) and the second-level manifold pipe F2, and flows into the first-level manifold pipe F1, and the two branch paths converge at the first-level manifold pipe F1, then flow through the manifold pipe 706, the four-way valve 106 (flow in from the fourth port Q4 and flow out from the third port Q3) and the gas-liquid separators 105, and return to the input ends of the compressors 102. In the state, the outer heat exchangers 101 are condensers, the inner heat exchangers 201 and the radiation assemblies 30 form evaporators, at the moment, the inner heat exchangers carry out convection refrigeration on the indoor air, the radiation assemblies 30 carry out radiation refrigeration on the indoor space, thus, the radiation assemblies 30 have an energy storage function, when the refrigerant in the system flows through the radiation assemblies 30, the radiation assemblies store low-temperature energy, the temperature of indoor ground is reduced along with air cold and hot exchange, and the refrigeration (auxiliary) effect is achieved. It should be noted that in the state, valves not mentioned are all in a closed state, the three-way valve 801 is located in the first position, and the three-way valve 802 is located in the first position.

The fourth refrigeration state of the air conditioner/heat pump heat storage refrigeration system 1: As shown in FIG. 18, the refrigerant flowing process of a fourth refrigeration state is the same as that of a third refrigeration state, in the state, the indoor unit 20 is connected with the radiation assemblies 30 in parallel, the indoor unit 20 also may have a dehumidification function while achieving refrigeration, during dehumidification, the rotating speed of draught fans of the inner heat exchangers 201 is low (much lower than the rotating speed during the refrigeration state), the inner heat exchangers 201 are mainly used for humidification, the radiation assemblies 30 are mainly used for refrigeration, the fourth refrigeration state is suitable to be used in spring, autumn and summer, as the indoor temperature is high in summer, the radiation assemblies 30 may cooperate with refrigeration, "conditional" ground refrigeration is achieved while dehumidification is achieved, indoor "wind-free" blowing feeling refrigeration is achieved, and the environment is more comfortable.

In the state, the indoor unit 20 and the radiation assemblies 30 are both evaporators, and the outer heat exchangers 101 are condensers. Although the indoor unit 20 and the radiation assemblies 30 are both the evaporators, but the indoor unit and the radiation assemblies "take up different posts", the indoor unit 20 is in charge of dehumidification, the radiation assemblies 30 are in charge of cooperating with "conditional" refrigeration, refrigeration is achieved while dehumidification is achieved, and therefore the whole machine energy efficiency is further improved.

The first dehumidification state of the air conditioner/heat pump heat storage refrigeration system 1: As shown in FIG. 16, the refrigerant flowing process of the first dehumidification process is the same as that of the first refrigeration state, the first dehumidification state is suitable to be used in spring and autumn in the south, the indoor unit 20 is used for dehumidification, and in the state, the radiation assemblies 30 do not participate in working. In the state, the indoor unit 20 is evaporator, and the outer heat exchangers 101 are condensers.

The second dehumidification state of the air conditioner/heat pump heat storage refrigeration system 1: As shown in FIG. 17, the refrigerant flowing process of a second dehumidification state is the same as that of the second refrigeration state, the second dehumidification state is suitable to be used in summer, the indoor unit 20 and the radiation assemblies 30 are connected in series for dehumidification, and in the state, the radiation assemblies 30 (radiation ground or ceilings) carry out refrigeration while the system carries out dehumidification. In the state, the indoor unit 20 and the radiation assemblies 30 are both evaporators, and the outer heat exchangers 101 are condensers. Although the indoor unit 20 and the radiation assemblies 30 are both the evaporators, but the indoor unit and the radiation assemblies "take up different posts", the indoor unit 20 is an evaporator front section to be in charge of dehumidification, the radiation assemblies 30 are evaporator rear sections to be in charge of "conditional" cooperative refrigeration, refrigeration is achieved while dehumidification is achieved, and the whole machine energy efficiency is improved.

Figure 19:
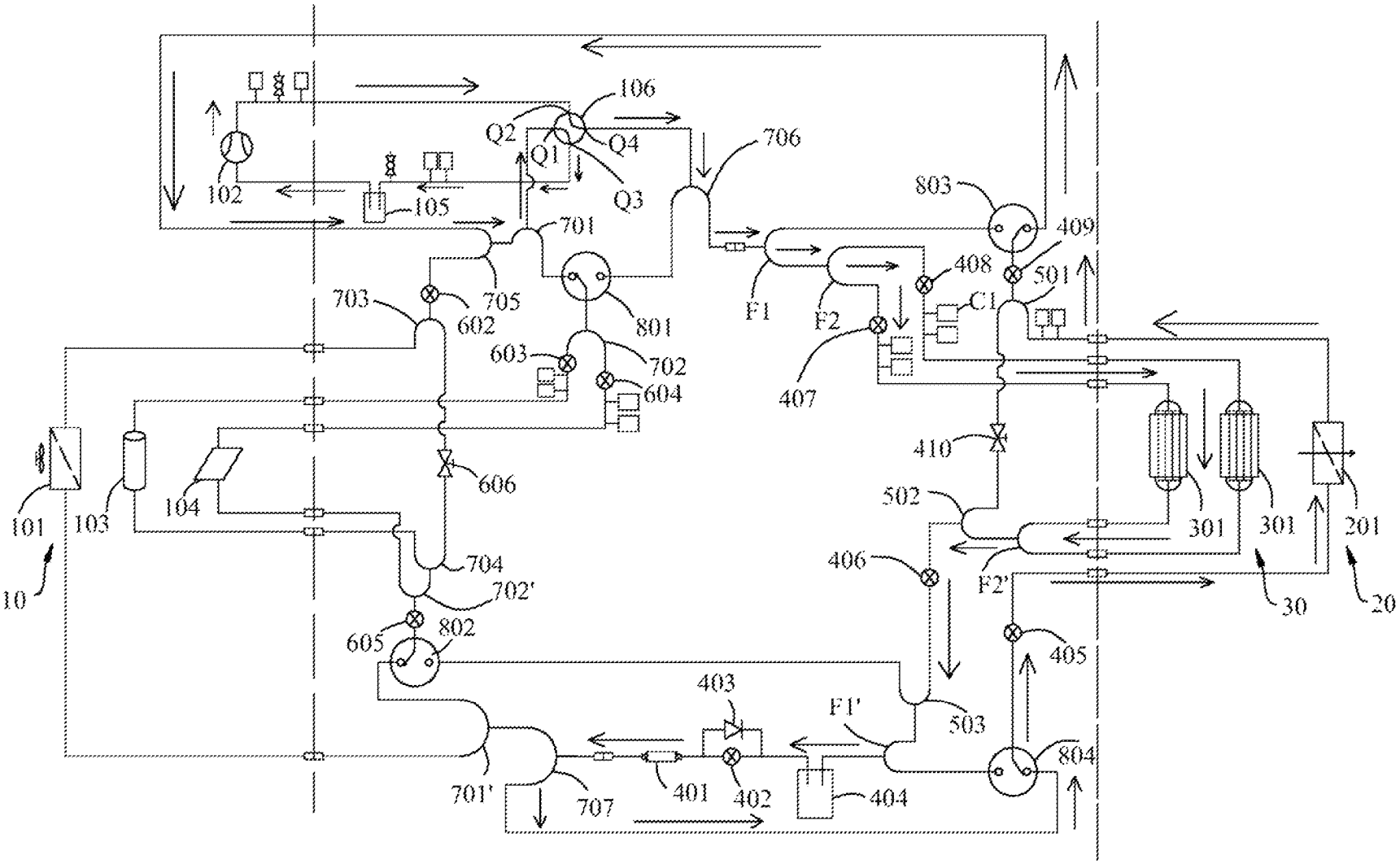
FIG. 19 is the refrigerant flow diagram of the third dehumidification state of an air conditioner/heat pump heat storage refrigeration system.

The third dehumidification state of the air conditioner/heat pump heat storage refrigeration system 1: As shown in FIG. 19, in a third dehumidification state, the radiation assemblies 30 and the indoor unit 20 "take up different posts" to be combined for dehumidification, the third dehumidification state is suitable to be used in winter (spring and autumn) in the south, and the outdoor unit 10 does not work. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the first-level manifold pipe F1, the second-level manifold pipe F2, the expansion valve 407 (expansion valve 408), the radiation units 301, the second-level manifold pipe F2', the manifold pipe 502, the expansion valve 406, the manifold pipe 503, the first-level manifold pipe F1', the liquid storage tank 404, the throttle part 402, the dryer 401, the manifold pipe 707, the three-way valve 804 (the second position), the expansion valve 405, the inner heat exchanger 201, the manifold pipe 501, the expansion valve 409, the three-way valve 803 (the second position, cut with the first manifold pipe F1), the manifold pipe 705, the manifold pipe 701, the four-way valve 106 (flow in from the first port Q1 and flow out from the third port Q3) and the gas-liquid separators 105, and returns to the input ends of the compressors 102. In the state, the inner heat exchangers 201 are evaporators, the radiation assemblies 30 are equivalent to condensers, the radiation assemblies 30 have the energy storage function, when the refrigerant in the system flows through the radiation assemblies 30, the radiation assemblies store high-temperature energy, the temperature of the indoor ground is increased along with air cold and hot exchange, humid air of the indoor space is removed while heating is carried out, one machine has heating and dehumidification functions at the same time, and the whole machine energy efficiency is greatly improved. It should be noted that in the state, valves not mentioned are all in a closed state, the three-way valve 801 is located in the first position, and the three-way valve 802 is located in the first position.

Figure 20:
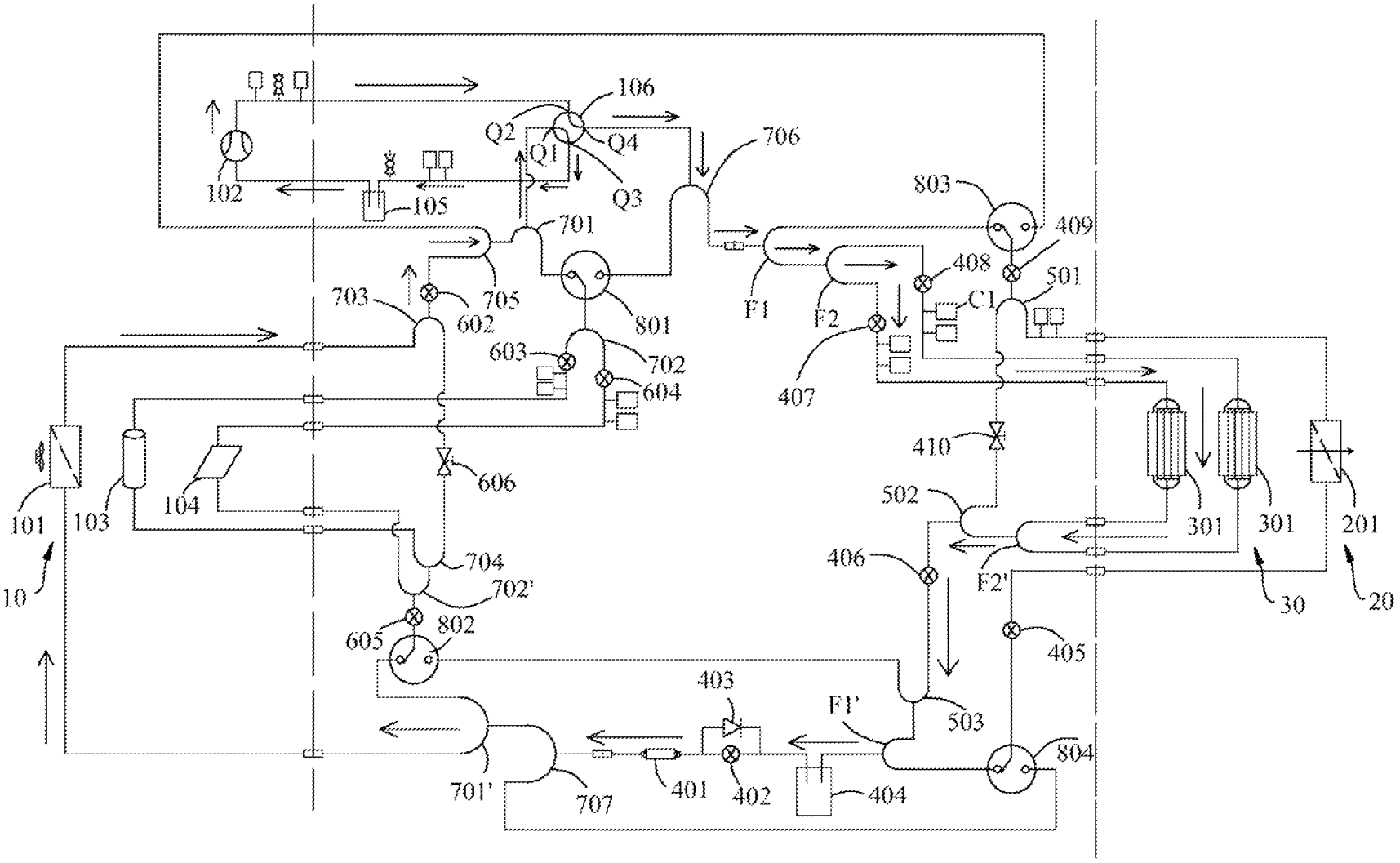
FIG. 20 is the refrigerant flow diagram of the first heating state of an air conditioner/heat pump heat storage refrigeration system.

The first heating state of the air conditioner/heat pump heat storage refrigeration system 1: As shown in FIG. 20, in a first heating state, the radiation assemblies 30 carry out heating, the outdoor unit 10 works, and the indoor unit 20 does not work. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the first-level manifold pipe F1, the second-level manifold pipe F2, the expansion valve 407 (expansion valve 408), the radiation units 301, the second-level manifold pipe F2', the manifold pipe 502, the expansion valve 406, the manifold pipe 503, the first-level manifold pipe F1', the liquid storage tank 404, the throttle part 402, the dryer 401, the manifold pipe 707, the manifold pipe 701', the outer heat exchangers 101, the manifold pipe 703, the expansion valve 602, the manifold pipe 705, the manifold pipe 701, the four-way valve 106 (flow in from the first port Q1 and flow out from the third port Q3) and the gas-liquid separators 105, and returns to the input ends of the compressors 102. In the state, the outer heat exchangers 101 are evaporators, the radiation assemblies 30 are equivalent to condensers, the refrigerant output by the compressors 102 is high-temperature gas, the high-temperature gas flows through the radiation assemblies 30, as the radiation assemblies 30 have the energy storage function, when the refrigerant in the system flows through the radiation assemblies 30, the radiation assemblies 30 store high-temperature energy, the temperature of the indoor ground is increased along with air cold and hot exchange, and the heating effect is achieved. It should be noted that in the state, valves not mentioned are all in a closed state, the three-way valve 801 is located in the first position, the three-way valve 802 is located in the first position, the three-way valve 803 is located in the first position, and the three-way valve 804 is located in the first position.

Figure 21:
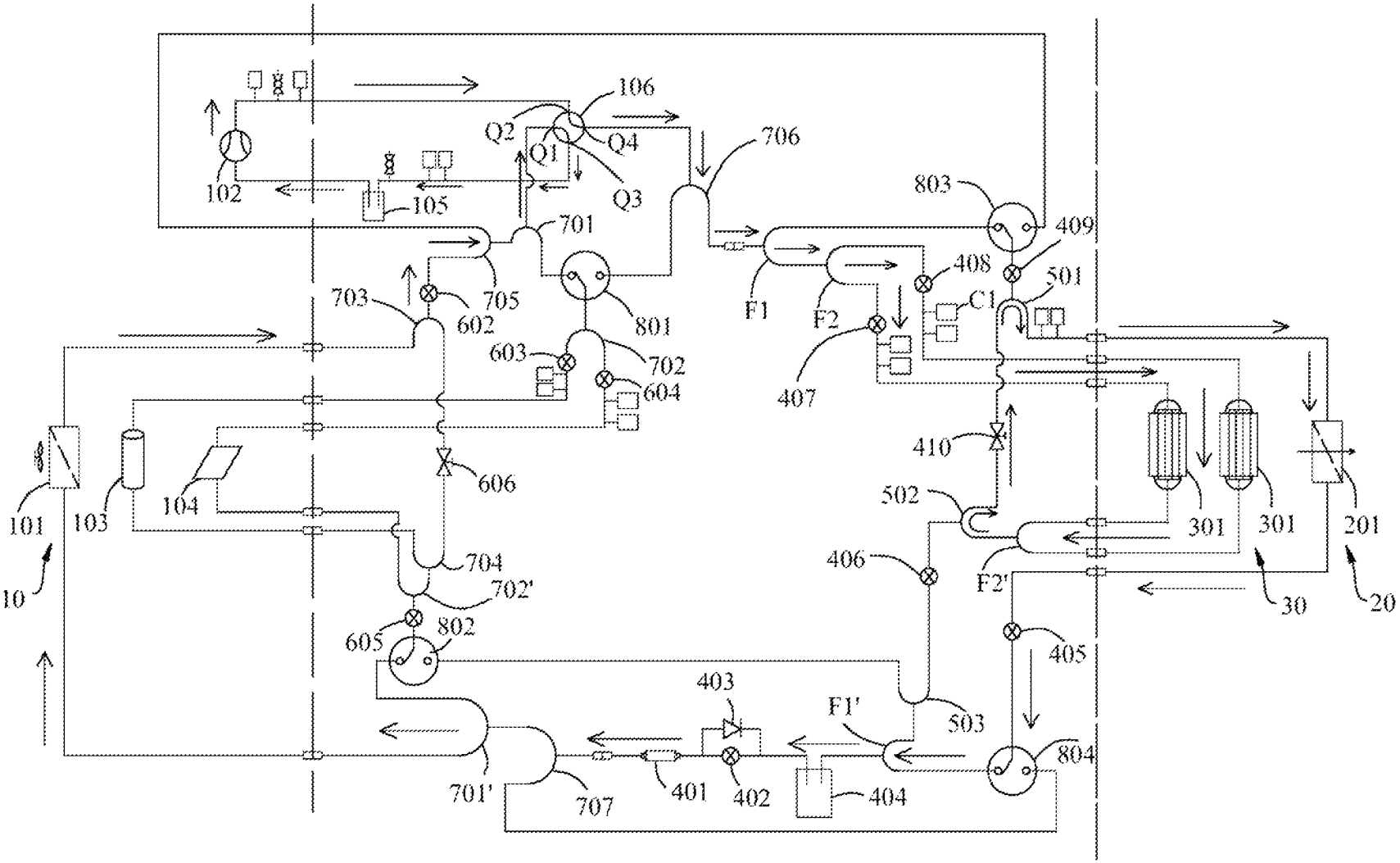
FIG. 21 is the refrigerant flow diagram of the second heating state of an air conditioner/heat pump heat storage refrigeration system.

The second heating state of the air conditioner/heat pump heat storage refrigeration system 1: As shown in FIG. 21, in a second heating state, the indoor unit 20 and the radiation assemblies 30 are connected in series for heating. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the first-level manifold pipe F1, the second-level manifold pipe F2, the expansion valve 407 (expansion valve 408), the radiation units 301, the second-level manifold pipe F2', the manifold pipe 502, the first adjusting stop valve 410, the manifold pipe 501, the inner heat exchanger 201, the expansion valve 405, the three-way valve 804 (the first position), the first-level manifold pipe F1', the liquid storage tank 404, the throttle part 402, the dryer 401, the manifold pipe 707, the manifold pipe 701', the outer heat exchangers 101, the manifold pipe 703, the expansion valve 602, the manifold pipe 705, the manifold pipe 701, the four-way valve 106 (flow in from the first port Q1 and flow out from the third port Q3) and the gas-liquid separators 105, and returns to the input ends of the compressors 102. In the state, the outer heat exchangers 101 are evaporators, the radiation assemblies 30 and the indoor unit 20 are condensers, the refrigerant output by the compressors 102 is high-temperature gas, the high-temperature gas flows through the radiation assemblies 30 and the indoor unit 20, the radiation assemblies 30 are condenser front sections, the indoor unit 20 is a condenser rear section, the temperature of the condenser front sections is high, the temperature of the condenser rear section is slightly lower than that of the condenser rear sections, the temperature of the indoor ground is increased along with air cold and hot exchange, and the whole machine energy efficiency may be improved through frequency conversion control of the inner heat exchangers 201 while the heating effect is achieved. It should be noted that in the state, valves not mentioned are all in a closed state, the three-way valve 801 is located in the first position, the three-way valve 802 is located in the first position, the three-way valve 803 is located in the first position, and the three-way valve 804 is located in the first position.

Figure 22:
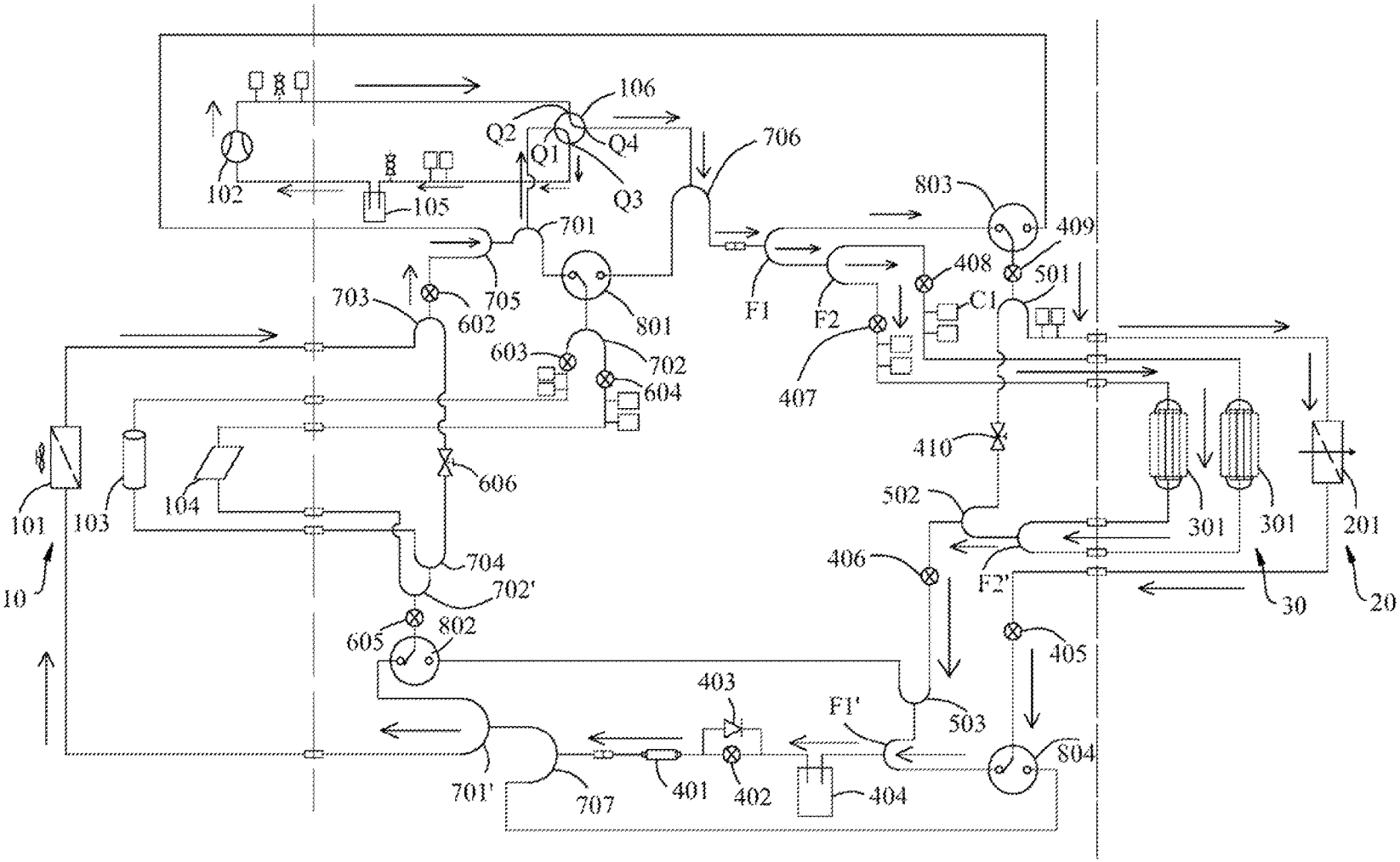
FIG. 22 is the refrigerant flow diagram of the third heating state of an air conditioner/heat pump heat storage refrigeration system.

The third heating state of the air conditioner/heat pump heat storage refrigeration system 1: As shown in FIG. 22, in a third heating state, the indoor unit 20 and the radiation assemblies 30 are connected in parallel for heating. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4) and the manifold pipe 706, and flows into the first-level manifold pipe F1, the refrigerant is divided into two branch paths at the first-level manifold pipe F1, one branch path flows through the second-level manifold pipe F2, the expansion valve 407 (expansion valve 408), the radiation units 301, the second-level manifold pipe F2', the manifold pipe 502, the expansion valve 406 and the manifold pipe 503, and flows into the first-level manifold pipe F1', the other branch path flows through the three-way valve 803 (first position), the expansion valve 409, the manifold pipe 501, the inner heat exchangers 201, the expansion valve 405 and the three-way valve 804 (first position), and flows into the first-level manifold pipe F1', after the two branch pipes converge in the first-level manifold pipe F1', the two branch paths flow into the liquid storage tank 404, the throttle part 402, the dryer 401, the manifold pipe 707, the manifold pipe 701', the outer heat exchangers 101, the manifold pipe 703, the expansion valve 602, the manifold pipe 705, the manifold pipe 701, the four-way valve 106 (flow in from the first port Q1 and flow out from the third port Q3) and the gas-liquid separators 105, and return to the input ends of the compressors 102. In the state, the outer heat exchangers 101 are evaporators, the indoor unit 20 and the radiation assemblies 30 are condensers, the refrigerant output by the compressors 102 is high-temperature gas, the high-temperature gas flows through the radiation assemblies 30 and meanwhile flows through the indoor unit 20, in the state, heating is mainly carried out by the ground radiation assemblies 30, air convection is assisted by the indoor unit 20, the temperature of the indoor ground and surrounding air is increased along with air cold and hot exchange, and the heating effect is achieved. It should be noted that in the state, valves not mentioned are all in a closed state, the three-way valve 801 is located in the first position, the three-way valve 802 is located in the first position, the three-way valve 803 is located in the first position, and the three-way valve 804 is located in the first position.

Figure 23:
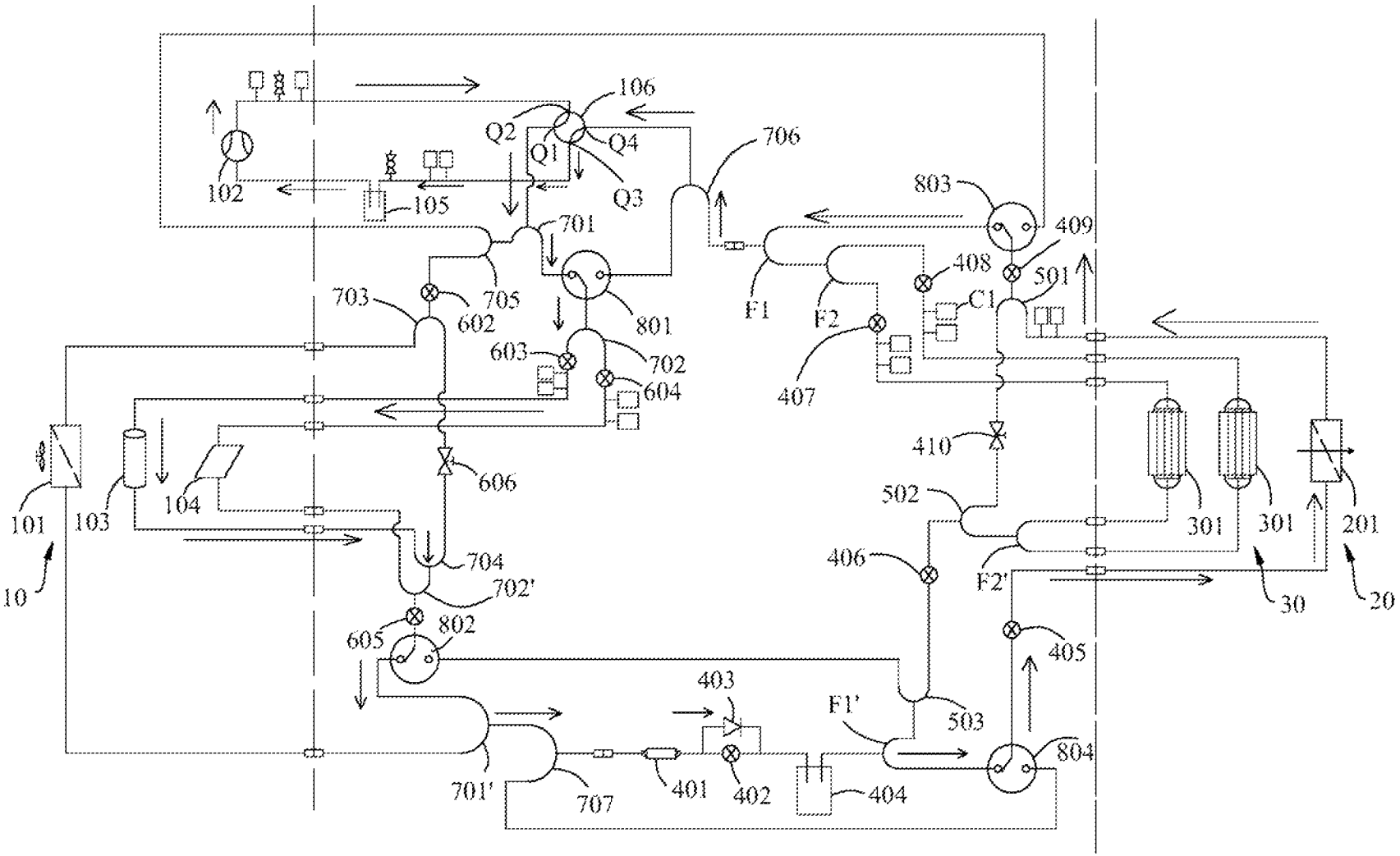
FIG. 23 is the refrigerant flow diagram of the first water heating state of an air conditioner/heat pump heat storage refrigeration system.

The first water heating state of the air conditioner/heat pump heat storage refrigeration system 1: As shown in FIG. 23, in a first water heating state, the indoor unit 20 and the water heater 103 participate in working, and the outer heat exchangers 101 do not participate in working. In the state, the first port Q1 of the four-way valve 106 communicates with the second port Q2, the third port Q3 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 701, the three-way valve 801 (the first position), the expansion valve 603, the water heater 103, the manifold pipe 704, the manifold pipe 702', the expansion valve 605, the three-way valve 802 (first position), the manifold pipe 701', the manifold pipe 707, the dryer 401, the one-way valve 403, the liquid storage tank 404, the first-level manifold pipe F1', the three-way valve 804 (first position), the expansion valve 405, enters the inner heat exchanger 201, and then is output to the manifold pipe 501, the expansion valve 409, the three-way valve 803 (the first position), the first-level manifold pipe F1, the manifold pipe 706, the four-way valve 106 (flow in front the first port, and flow out from the third port Q3) and the gas-liquid separators 105, and returns to the input ends of the compressors 102. In the state, the inner heat exchangers 201 are evaporators, the water heater 103 is a condenser, the high-temperature and high-pressure refrigerant of the compressors 102 flows through the water heater 103 to heat the water in the water heater 103, and meanwhile the inner heat exchangers 201 take (evaporate) indoor heat away (refrigerate indoor space). At the time, the indoor refrigeration is "free of charge". It should be noted that in the state, valves not mentioned are all in a closed state.

In the first water heating state, the radiation assemblies 30 selectively participate in refrigeration, the radiation assemblies 30 are evaporators, when the expansion valve 406 and the expansion valve 407 (expansion valve 408) are opened, the refrigerant flows through the first-level manifold pipe F1', then flows into the manifold pipe 503, the expansion valve 406, the manifold pipe 502, the second-level manifold pipe F2', the radiation units 301, the expansion valve 407 (expansion valve 408) and the second-level manifold pipe F2, and flows into the first-level manifold pipe F1, and the refrigerant flowing out from the first-level manifold pipe F1 and the inner heat exchangers 201 converges and flows into the manifold pipe 706. When the radiation assemblies 30 participate in working, the radiation assemblies 30 are used for refrigerating the ground, and meanwhile the temperature of the indoor air is reduced.

Figure 24:
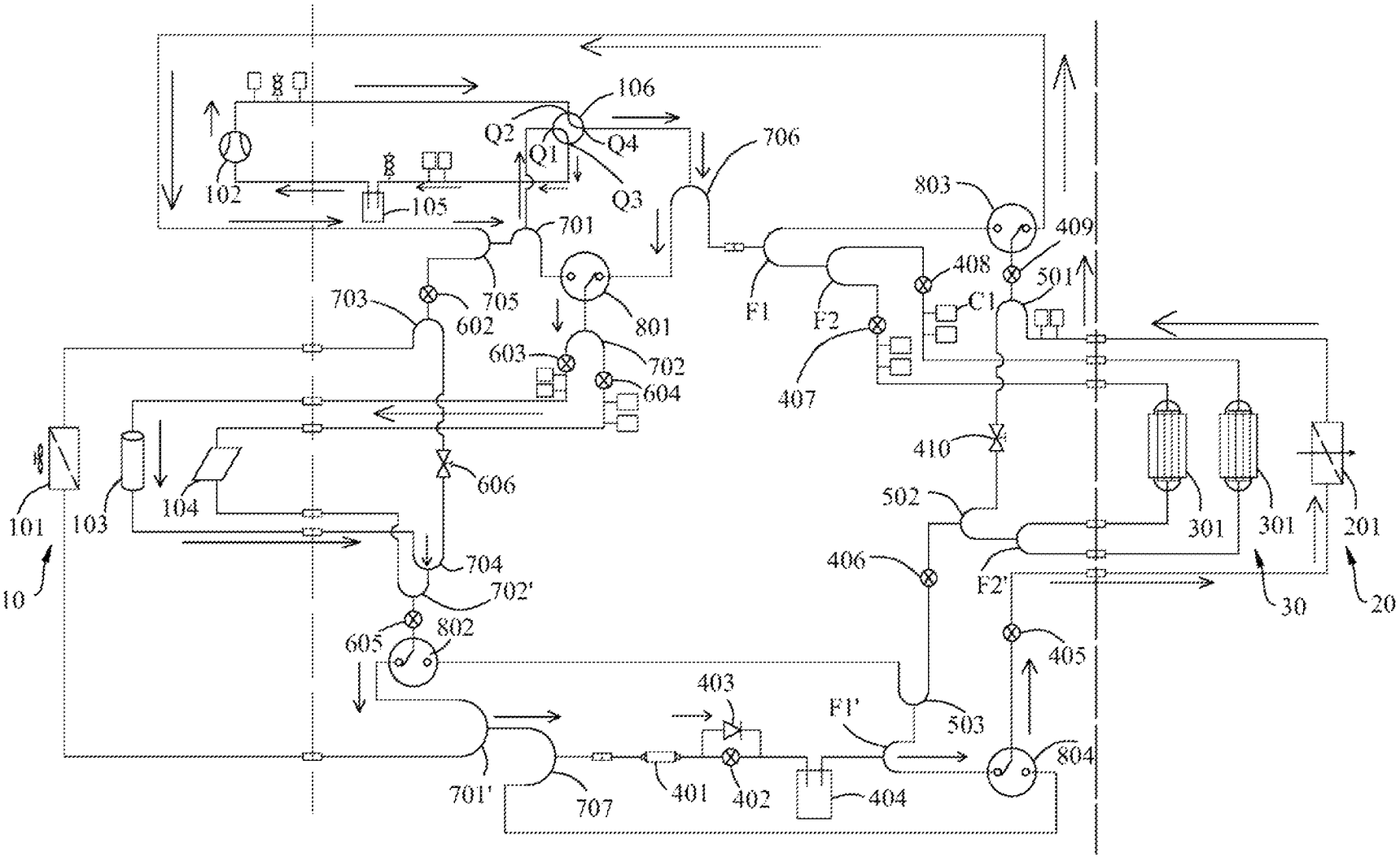
FIG. 24 is the refrigerant flow diagram of the second water heating state of an air conditioner/heat pump heat storage refrigeration system.

The second water heating state of the air conditioner/heat pump heat storage refrigeration system 1: As shown in FIG. 24, in a second water heating state, the indoor unit 20 heats water, and the radiation assemblies 30 do not participate in working. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the three-way valve 801 (second position, communicate with the manifold pipe 706), the manifold pipe 702, the expansion valve 603, the water heater 103, the manifold pipe 704, the manifold pipe 702', the expansion valve 605, the three-way valve 802 (first position), the manifold pipe 701', the manifold pipe 707, the dryer 401, the manifold pipe 707, the dryer 401, the one-way valve 403, the liquid storage tank 404, the first-level manifold pipe F1', the three-way valve 804 (first position), the expansion valve 405, the inner heat exchangers 201, the manifold pipe 501, the expansion valve 409, the three-way valve 803 (second position), the manifold pipe 705, the manifold pipe 701, the four-way valve 106 (flow in front the first port Q1, and flow out from the third port Q3) and the gas-liquid separators 105, and returns to the input ends of the compressors 102. In the state, the inner heat exchangers 201 are evaporators, the water heater 103 is a condenser, the high-temperature and high-pressure refrigerant of the compressors 102 flows through the water heater 103 to heat the water in the water heater 103, and meanwhile the inner heat exchangers 201 take (evaporate) indoor heat away (refrigerate indoor space). It should be noted that in the state, valves not mentioned are all in a closed state.

Figure 25:
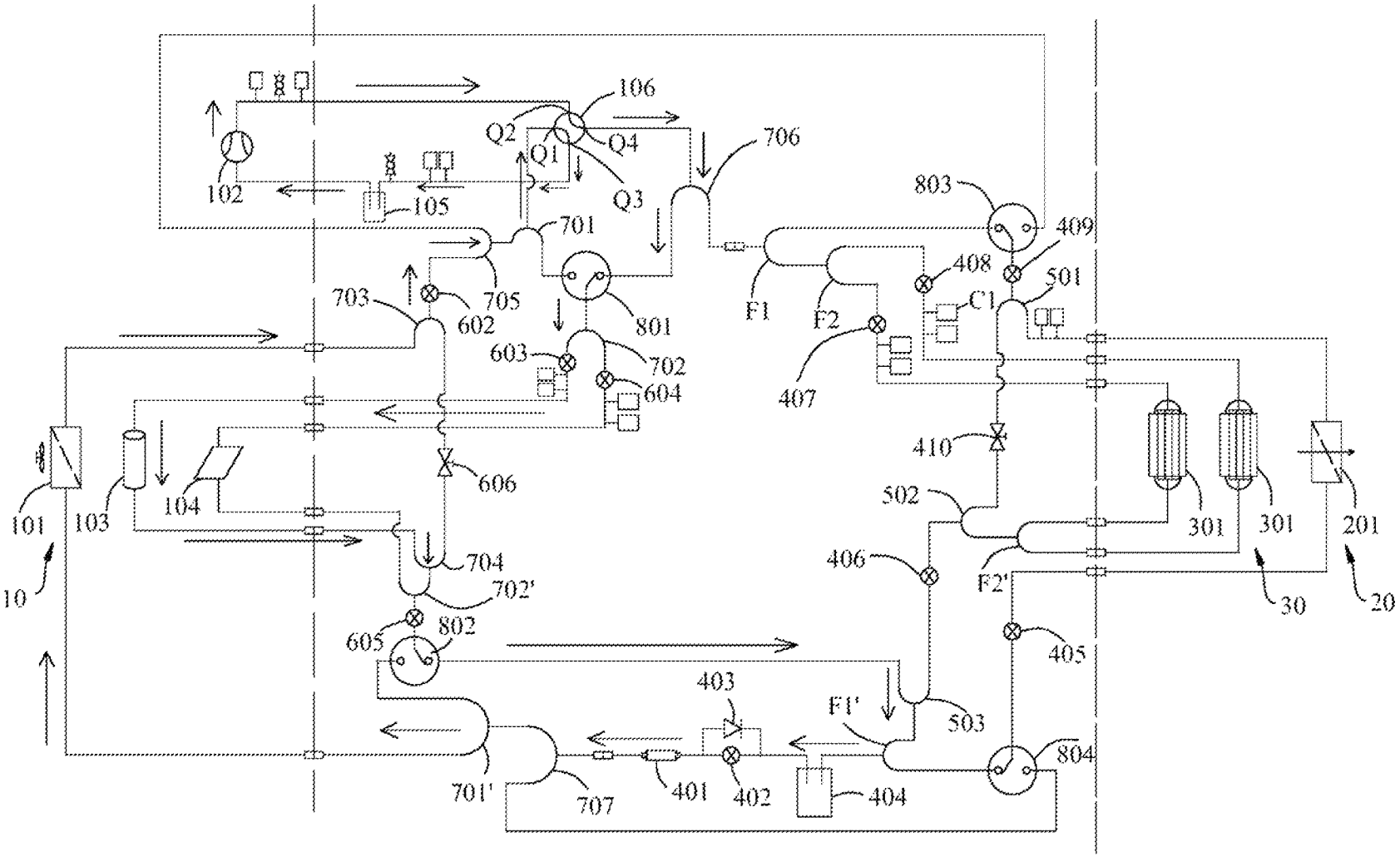
FIG. 25 is the refrigerant flow diagram of the third water heating state of an air conditioner/heat pump heat storage refrigeration system.

The third water heating state of the air conditioner/heat pump heat storage refrigeration system 1: As shown in FIG. 25, in a third water heating state, the outdoor unit 10 heats water, and the indoor unit 20 and the radiation assemblies 30 do not work. In the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the three-way valve 801 (the second position), the manifold pipe 702, the expansion valve 603, the water heater 103, the manifold pipe 704, the manifold pipe 702', the expansion valve 605, the three-way valve 802 (the second position), the manifold pipe 503, the first-level manifold pipe F1', the liquid storage tank 404, the throttle part 402, the dryer 401, the manifold pipe 707, the manifold pipe 701', the outer heat exchangers 101, the manifold pipe 703, the expansion valve 602, the manifold pipe 705, the manifold pipe 701, the four-way valve 106 (flow in from the first port Q1 and flow out from the third port Q3) and the gas-liquid separators 105, and returns to the input ends of the compressors 102. In the state, the outer heat exchangers 101 are evaporators, the water heater 103 is a condenser, and the high-temperature and high-pressure refrigerant of the compressors 102 flows through the water heater 103 to heat the water in the water heater 103. It should be noted that in the state, valves not mentioned are all in a closed state, the three-way valve 801 is located in the second position, the three-way valve 802 is located in the second position, the three-way valve 803 is located in the first position, and the three-way valve 804 is located in the first position.

An "automatic" water heating state is provided, namely, a mode is set, the refrigerant is pumped into the outer heat exchangers 101 before shutdown, all channels for connection of the inner heat exchangers 201 (including the radiation assemblies (30) and the outer heat exchangers 101 are closed after shutdown, most of the medium is stored in the water heater 103 and the illumination assembly 104 (outer heat exchangers 101), when the illumination assembly 104 is heated by the solar energy, the medium originally flowing freely forms cold and hot circulating flow in cavities of the illumination assembly 104 (heated) and the water heater 103

(not heated), along with change of the temperature difference, finally a heat value balance is achieved, but at the moment, low-temperature water in a box body of the water heater 103 may carry out cold and hot exchange with the medium cavity of the water heater to achieve a heat balance, and therefore the water in the water heater 103 is "automatically" heated.

Figure 26:
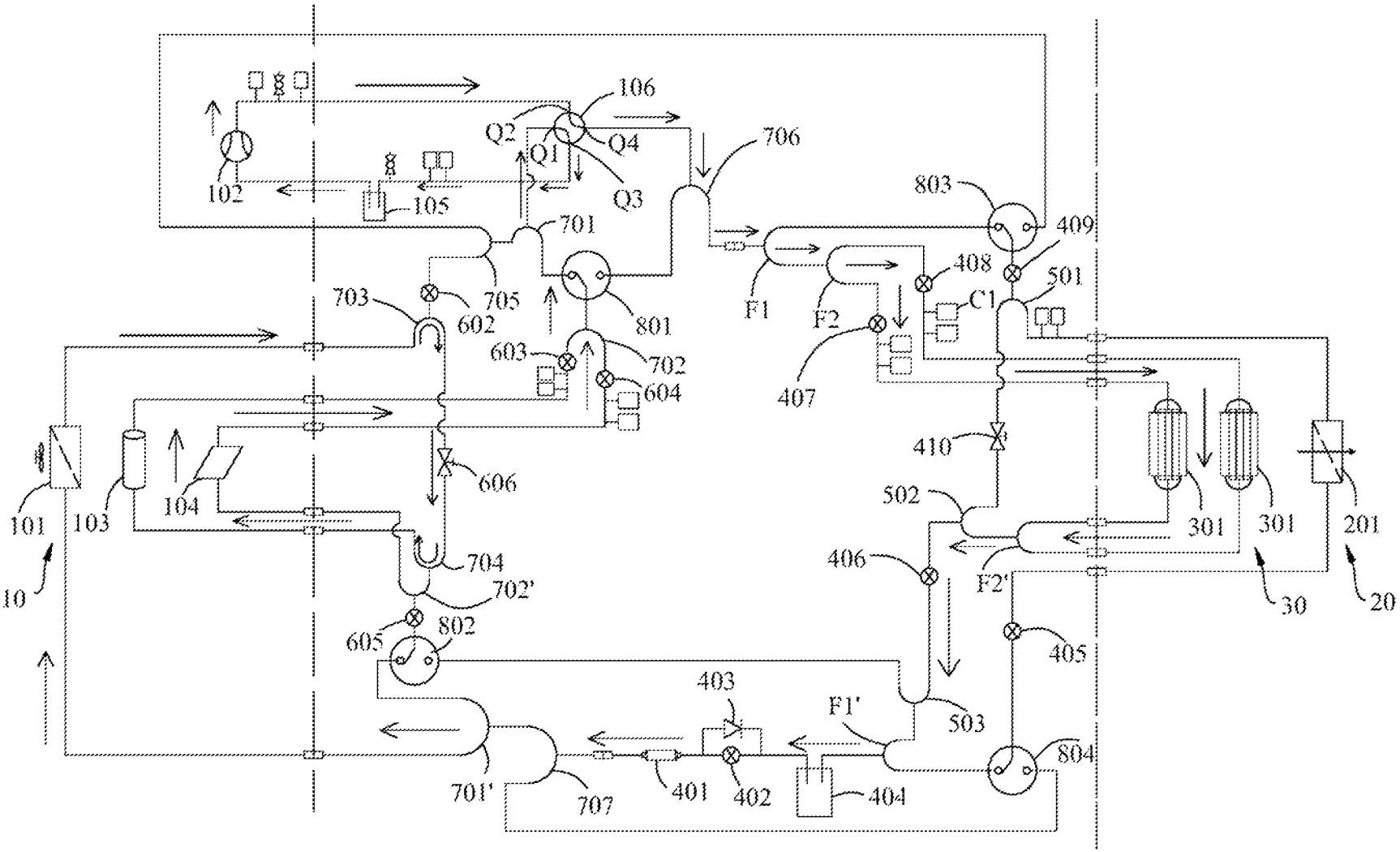
FIG. 26 is a refrigerant flow diagram of "secondary evaporation" of an air conditioner/heat pump heat storage refrigeration system.

The "secondary evaporation" of the air conditioner/heat pump heat storage refrigeration system 1: As shown in FIG. 26, in the state, the first port Q1 of the four-way valve 106 communicates with the third port Q3, the second port Q2 communicates with the fourth port Q4, and the refrigerant flowing process is as follows: The refrigerant flows out from the output ends of the compressors 102, sequentially flows through the four-way valve 106 (flow in from the second port Q2 and flow out from the fourth port Q4), the manifold pipe 706, the first-level manifold pipe F1, the second-level manifold pipe F2, the expansion valve 407 (expansion valve 408), the radiation units 301, the second-level manifold pipe F2', the manifold pipe 502, the expansion valve 406, the manifold pipe 503, the first-level manifold pipe F1', the liquid storage tank 404, the throttle part 402, the dryer 401, the manifold pipe 707, the manifold pipe 701', the outer heat exchangers 101, the manifold pipe 703, the second adjusting stop valve 606, the manifold pipe 704, the water heater 103, the expansion valve 603 (or the manifold pipe 702', the illumination assembly 104, the expansion valve 604), the manifold pipe 702, the three-way valve 801 (the first position), the manifold pipe 701, the four-way valve 106 (flow in from the first port Q1 and flow out from the third port Q3) and the gas-liquid separators 105, and returns to the input ends of the compressors 102. In the state, the state is mainly applied to winter, and under the condition that the outdoor environmental temperature is low, the outer heat exchangers 101 are evaporators; and as the outdoor environmental temperature is low, the outer heat exchangers 101 "do not have the capacity" of fetching more heat energy from the outside, at the moment, the gas inlet temperature of inlets of the compressors 102 is low, at the moment, a device ("heating" water heater 103 or illumination assembly 104) capable of increasing the temperature of the refrigerant is connected to the tail ends of the outer heat exchangers 101 in series, and the working capacity of the unit under the low-temperature environment condition is improved (extended). Pipelines for bearing the refrigerant are arranged in the water heater 103 herein, after the water heater is connected with the outer heat exchangers 101 in series, when the refrigerant flows through the water heater 103, hot water at certain high temperature in the water heater 103 "indirectly" heats the refrigerant, the temperature of the refrigerant entering the compressors 102 is increased, and therefore the working capacity of the whole unit in the low-temperature environment is improved. It should be noted that in the state, valves not mentioned are all in a closed state, the three-way valve 801 is located in the first position, the three-way valve 802 is located in the first position, the three-way valve 803 is located in the first position, and the three-way valve 804 is located in the first position.

It should be noted that the characteristics in the embodiments of the application may be combined with each other if they are not in conflict.

The above mentioned is only the preferred embodiment of the application, but not to limit the application. The technicians in this field can variedly modify and change the application. Any modifications, equivalent substitutions, improvements, etc. made within the spirit and principle of the application should be comprised in the scope of protection of the application.

What is claimed is:

1. An air conditioner/heat pump heat storage refrigeration system, comprising:

an outdoor unit, an indoor unit, radiation assemblies, and an air conditioner/heat pump expansion function box;

wherein the air conditioner/heat pump expansion function box comprises expansion function box bodies and two distribution pipelines installed in the expansion function box bodies;

each distribution pipeline in the two distribution pipelines comprises a main path and at least one branch path communicating with the main path, a first end of each main path is provided with an outdoor unit nut head; a second end of each main path is provided with an indoor unit nut head; an end portion of each branch path is provided with a radiation assembly nut head, one radiation assembly nut head group is formed by all the radiation assembly nut heads of each distribution pipeline, the two outdoor unit nut heads are used for being connected with an inlet and an outlet of the outdoor unit, the two indoor unit nut heads are used for being connected with an inlet and an outlet of the indoor unit, and the two radiation assembly nut head groups are used for being connected with inlets and outlets of radiation assemblies;

the outdoor unit and the indoor unit are connected into a loop through the air conditioner/heat pump expansion function box, the outdoor unit and the radiation assemblies are connected into a loop through the air conditioner/heat pump expansion function box, and the indoor unit and the radiation assemblies are connected into a loop through the air conditioner/heat pump expansion function box;

wherein the outdoor unit comprises outer heat exchangers, compressors and a four-way valve connected with the compressors, outlet ends of the outer heat exchangers are connected with a first port of the four-way valve, inlet ends of the outer heat exchangers are connected with one outdoor unit nut head of the air conditioner/heat pump expansion function box, a second port of the four-way valve communicates with outlet ends of the compressors, inlet ends of the compressors are connected with a third port of the four-way valve, and a fourth port of the four-way valve is connected with the other outdoor unit nut head of the air conditioner/heat pump expansion function box;

the indoor unit comprises inner heat exchangers, inlet ends of the inner heat exchangers are connected with one indoor unit nut head, and outlet ends of the inner heat exchangers are connected with the other indoor unit nut head;

each distribution pipeline of the air conditioner/heat pump expansion function box comprises one first-level manifold pipe and one second-level manifold pipe, the first-level manifold pipe comprises a first-level main pipe and two first-level branch pipes, the second-level manifold pipe comprises a second-level main pipe and two second-level pipes, the second-level main pipe communicates with one first-level branch pipe in the two first-level branch pipes, the other first-level branch pipe in the two first-level branch pipes is connected with the indoor unit, and the two second-level branch pipes are connected with the radiation assemblies;

the air conditioner/heat pump expansion function box is further internally provided with a first adjusting pipeline, one end of the first adjusting pipe communicates with the first-level branch pipes of the first-level manifold pipe of the indoor unit nut head of one distribution pipeline, the other end of the first adjusting pipe communicates with one second-level branch pipe of the second-level manifold pipe of the other distribution pipeline, the first adjusting pipeline is provided with a first adjusting stop valve, and the first adjusting stop valve is used for controlling on or off of the first adjusting pipeline in order to change serial and parallel modes of the radiation assemblies and the inner heat exchangers.

2. The air conditioner/heat pump heat storage refrigeration system according to claim 1, wherein the air conditioner/heat pump heat storage refrigeration system further comprises a water heater, an illumination assembly and an auxiliary function box, wherein two auxiliary pipelines are arranged in the auxiliary function box, each auxiliary pipeline comprises a first-level auxiliary manifold pipe and a second-level auxiliary manifold pipe, a main pipe of the second-level auxiliary manifold pipe is connected with one branch pipe of the first-level auxiliary manifold pipe, the end portion of a main pipe of the first-level auxiliary manifold pipe is connected with an auxiliary inlet end, and the end portion of the other branch pipe of the first-level auxiliary manifold pipe and the end portions of two branch pipes of the second-level auxiliary manifold pipes are provided with auxiliary outlet ends correspondingly;

the two auxiliary pipelines are the first auxiliary pipeline and the second auxiliary pipeline correspondingly, the auxiliary inlet end of the first auxiliary pipeline is connected with the first port of the four-way valve, the three auxiliary outlet ends of the first auxiliary pipeline are connected with outlet ends of the outer heat exchangers, an outlet end of the water heater and an outlet end of the illumination assembly correspondingly, the auxiliary inlet end of the second auxiliary pipeline is connected with the outdoor unit nut head corresponding to inlet ends of the outer heat exchangers, and the three auxiliary outlet ends of the second auxiliary pipeline are connected with the inlet ends of the outer heat exchangers, an inlet end of the water heater and an inlet end of the illumination assembly correspondingly;

the auxiliary function box is further internally provided with a second adjusting pipeline, one end of the second adjusting pipe communicates with the branch pipe, provided with the auxiliary outlet end, of the first-level auxiliary manifold pipe of the first auxiliary pipeline, the other end of the second adjusting pipe communicates with one branch pipe of the second-level auxiliary manifold pipe of the second auxiliary pipeline, the second adjusting pipeline is provided with a second adjusting stop valve, and the second adjusting stop valve is used for controlling on or off of the second adjusting pipeline in order to change serial and parallel modes of the outer heat exchangers, the water heater and the illumination assembly.

* * * * *